US008146736B2

(12) United States Patent
Downes

(10) Patent No.: US 8,146,736 B2
(45) Date of Patent: Apr. 3, 2012

(54) KEY ORGANIZING DEVICE

(75) Inventor: Josh Downes, Henderson, NV (US)

(73) Assignee: Keyport, Inc., Henderson, NV (US)

( * ) Notice: Subject to any disclaimer, the term of this patent is extended or adjusted under 35 U.S.C. 154(b) by 0 days.

(21) Appl. No.: 12/442,098

(22) PCT Filed: Sep. 19, 2007

(86) PCT No.: PCT/US2007/078960

§ 371 (c)(1),
(2), (4) Date: Mar. 19, 2009

(87) PCT Pub. No.: WO2008/036783

PCT Pub. Date: Mar. 27, 2008

(65) Prior Publication Data

US 2010/0000885 A1 Jan. 7, 2010

Related U.S. Application Data

(60) Provisional application No. 60/845,887, filed on Sep. 19, 2006, provisional application No. 60/845,998, filed on Sep. 20, 2006.

(51) Int. Cl.
*A45C 11/32* (2006.01)

(52) U.S. Cl. ..... 206/37.2; 206/37.6; 206/38.1; 70/456 R

(58) Field of Classification Search ..... 206/37, 206/476, 37.2, 37.3–37.8, 39.1; 70/456 R, 70/408, 459, 457, 458, 456 B, 460
See application file for complete search history.

(56) References Cited

U.S. PATENT DOCUMENTS 1,665,016 A 4/1928 Benham et al.
1,936,273 A 11/1933 Segal
(Continued)

FOREIGN PATENT DOCUMENTS

EP 1 621 100 A2 2/2006
(Continued)

OTHER PUBLICATIONS

International Preliminary Report on Patentability dated Jun. 15, 2010, Written Opinion of the International Searching Authority dated May 18, 2009, and International Search Report dated May 18, 2009, for International PCT/US2008/086896, filed Dec. 15, 2008.

(Continued)

*Primary Examiner* — J. Gregory Pickett
*Assistant Examiner* — Raven Collins
(74) *Attorney, Agent, or Firm* — Pearne & Gordon LLP

(57) ABSTRACT

Key organizing device including housing, cover, and slider. Housing includes cavity, two housing ends, end opening, back wall, and slider opening. Housing ends are spaced apart in longitudinal direction. End opening is located at one housing end. Back wall is located at other housing end. Slider opening extends in longitudinal direction. Cover is removeably attached over end opening. Slider includes finger pad and key mount. Key mount is positioned inside cavity and connected to finger pad through slider opening. Slider is configured for attachment and detachment of key through end opening upon removal of cover. Key including key head connected to key blade, key head having edge, key including head aperture spaced apart from the edge, key head including ramp between two guide ridges. Key including key head connected to key blade, key head having edge and head aperture, head aperture including notch in edge.

23 Claims, 43 Drawing Sheets

U.S. PATENT DOCUMENTS

| | | | | | |
|---|---|---|---|---|---|
| 1,996,933 | A | | 4/1935 | Segal | |
| 2,076,895 | A | | 4/1937 | Johnston | |
| 2,493,330 | A | | 1/1950 | Zimmerman | |
| 2,503,380 | A | | 4/1950 | Derby | |
| 2,541,333 | A | | 2/1951 | Campbell | |
| 2,558,265 | A | | 6/1951 | Mosch | |
| 2,560,595 | A | | 7/1951 | Poncar | |
| 2,575,424 | A | * | 11/1951 | Mitchell | 70/456 R |
| 2,605,632 | A | | 8/1952 | Lamonde | |
| 2,637,994 | A | | 5/1953 | Harrison, Jr. et al. | |
| 2,640,347 | A | * | 6/1953 | Majeski | 70/456 R |
| 2,669,859 | A | | 2/1954 | Hudson, Jr. | |
| 2,695,511 | A | | 11/1954 | Wing et al. | |
| 2,789,613 | A | | 4/1957 | Corsaw | |
| 2,790,319 | A | | 4/1957 | Brunner | |
| 3,004,422 | A | | 10/1961 | Starrett | |
| 3,147,609 | A | | 9/1964 | Ryan | |
| 3,328,986 | A | | 7/1967 | Ralton | |
| 3,354,678 | A | | 11/1967 | Stifelman | |
| 3,407,636 | A | | 10/1968 | Kovacevic | |
| 3,457,746 | A | | 7/1969 | Glassman | |
| 3,606,777 | A | | 9/1971 | Watson | |
| 3,618,346 | A | | 11/1971 | Humphrey | |
| 3,729,965 | A | | 5/1973 | Gartner | |
| 3,765,200 | A | | 10/1973 | Vogt | |
| 3,813,907 | A | | 6/1974 | Jones, Jr. et al. | |
| 3,832,874 | A | | 9/1974 | Willis | |
| 3,950,973 | A | | 4/1976 | Grasnianski | |
| 4,006,613 | A | | 2/1977 | Zion | |
| 4,305,267 | A | | 12/1981 | Nish et al. | |
| 4,417,410 | A | | 11/1983 | Freedom | |
| 4,569,215 | A | | 2/1986 | McCarthy | |
| 4,601,185 | A | | 7/1986 | Sheldon | |
| 4,646,913 | A | | 3/1987 | Wing et al. | |
| 4,909,054 | A | | 3/1990 | Fox | |
| D307,863 | S | | 5/1990 | Boag | |
| 4,941,335 | A | | 7/1990 | Allen | |
| 4,951,489 | A | | 8/1990 | Proch | |
| 4,951,819 | A | | 8/1990 | Gebert | |
| 5,123,579 | A | | 6/1992 | Sugiyama | |
| 5,215,190 | A | | 6/1993 | Hoffpauir, Jr. | |
| 5,228,563 | A | | 7/1993 | Stringham | |
| 5,232,086 | A | * | 8/1993 | Montanari | 206/37.2 |
| 5,487,291 | A | | 1/1996 | Voigt | |
| 5,495,942 | A | * | 3/1996 | Izhak | 206/372 |
| 5,544,510 | A | | 8/1996 | Botteon et al. | |
| 5,943,889 | A | * | 8/1999 | Chiu | 70/456 R |
| 6,092,405 | A | | 7/2000 | Berwick | |
| 6,237,756 | B1 | * | 5/2001 | Caudle | 206/37.2 |
| 6,367,298 | B1 | | 4/2002 | Janssen et al. | |
| 6,371,286 | B1 | * | 4/2002 | Montanari | 206/37.3 |
| 6,473,022 | B1 | | 10/2002 | Wu | |
| 6,604,308 | B1 | | 8/2003 | Robles | |
| 6,755,061 | B2 | | 6/2004 | Herzenberg | |
| 6,763,938 | B1 | | 7/2004 | Nelson | |
| D499,323 | S | * | 12/2004 | Smith | D8/90 |
| 6,892,558 | B2 | | 5/2005 | Chodosh | |
| 6,928,845 | B2 | | 8/2005 | Howard | |
| 7,055,352 | B2 | * | 6/2006 | Meyerson et al. | 70/456 R |
| D530,186 | S | | 10/2006 | Johansson | |
| 7,127,922 | B2 | | 10/2006 | Khounsombath et al. | |
| 7,360,383 | B1 | | 4/2008 | Chang | |
| D569,227 | S | | 5/2008 | Boenisch | |
| D592,935 | S | | 5/2009 | Mesh et al. | |
| D618,983 | S | | 7/2010 | Downes | |
| D624,305 | S | | 9/2010 | Downes | |
| 2003/0167810 | A1 | | 9/2003 | Frias | |
| 2003/0172696 | A1 | | 9/2003 | Regina | |
| 2004/0055347 | A1 | | 3/2004 | Herzenberg | |
| 2004/0069661 | A1 | | 4/2004 | Telleen | |
| 2005/0103070 | A1 | | 5/2005 | Meyerson et al. | |
| 2005/0103071 | A1 | | 5/2005 | Ng | |
| 2005/0199628 | A1 | | 9/2005 | Van Handel et al. | |
| 2005/0204789 | A1 | | 9/2005 | Camean et al. | |
| 2005/0217327 | A1 | | 10/2005 | Frias Frias et al. | |
| 2006/0044109 | A1 | | 3/2006 | Griffits et al. | |
| 2006/0044116 | A1 | | 3/2006 | Mehler et al. | |
| 2006/0086163 | A1 | | 4/2006 | Downes | |
| 2011/0016937 | A1 | | 1/2011 | Downes | |
| 2011/0072870 | A1 | | 3/2011 | Downes | |

FOREIGN PATENT DOCUMENTS

| | | | |
|---|---|---|---|
| WO | 9933370 | | 7/1999 |
| WO | 03/082063 | A1 | 10/2003 |
| WO | 2003/082063 | A1 | 10/2003 |
| WO | 2007/050442 | A1 | 10/2006 |
| WO | 2007/050442 | A1 | 5/2007 |
| WO | 2008036783 | A1 | 3/2008 |
| WO | 2009079482 | A2 | 6/2009 |
| WO | 2011038372 | A1 | 3/2011 |

OTHER PUBLICATIONS

International Preliminary Report on Patentability dated Apr. 23, 2008, Written Opinion of the International Searching Authority dated Feb. 16, 2007, and International Search Report dated Feb. 16, 2007, for International PCT/US2006/040972, filed Oct. 20, 2006.

International Preliminary Report on Patentability dated Mar. 24, 2009, Written Opinion of the International Searching Authority dated Dec. 8, 2008, and International Search Report dated Dec. 17, 2008, for International PCT/US2007/078960, filed Sep. 19, 2007.

International Search Report dated Feb. 17, 2011, for International PCT/US2010/050451, filed Sep. 27, 2010.

* cited by examiner

KEY ORGANIZING DEVICE

PRIORITY

This invention claims priority to U.S. Provisional Patent Application Ser. No. 60/845,887 filed Sep. 19, 2006, titled KEY ORGANIZATION DEVICE, and to U.S. Provisional Patent Application Ser. No. 60/845,998 filed Sep. 20, 2006, titled KEY ORGANIZATION DEVICE, both applications of which are incorporated in their entirety by reference in this application.

BACKGROUND OF THE INVENTION

1. Field of the Invention

This invention generally relates to keys, and to devices for holding keys.

2. Related Art

Keys for locks have been ubiquitous for centuries. Many types of devices for holding keys have been developed that use rings, clips, chains, wallets, enclosures, and other structures to join keys together. In spite of all of the work that has been done to provide devices that organize keys for storage and convenient access, many people still tend to either mount their keys on a simple key ring, or use a wallet having rings for mounting keys. Both of these two types of key holding devices are generally perceived as disorganized and cumbersome. Meanwhile, keys generally have a chaotic variety of shapes and sizes, further contributing to the disorganization of a typical person's keys. A continuing need exists for standardized keys, and for a device for holding keys that facilitates organization of an end user's keys for secure storage and convenient use.

SUMMARY

In an example of an implementation, a key organizing device is provided, including a housing, a cover, and a slider. The housing includes a cavity, two housing ends, an end opening, a back wall, and a slider opening. The two housing ends are spaced apart in a longitudinal direction. The end opening is located at one of the housing ends. The back wall is located at the other housing end. The slider opening extends in the longitudinal direction. The cover is removeably attached over the end opening. The slider includes a finger pad and a key mount. The key mount is positioned inside the cavity and connected to the finger pad through the slider opening. The slider is configured for attachment and detachment of a key through the end opening upon removal of the cover. In examples, the key organizing device may further include one or more of the following features.

The key mount of the key organizing device may include spaced-apart first and second key mounting plates, the first key mounting plate having a mounting post projecting toward the second key mounting plate. The second key mounting plate may include a plate opening in spaced-apart alignment with the mounting post. The key mount may be configured for guiding the mounting post into and out of a head aperture of a key, and for guiding a key head of a key into and out of the key mount. The key mounting plates may be configured for sliding over a ramp between two guide ridges on a key head. The mounting post may be configured for sliding across a notch in a key head.

The key organizing device may include a key removeably attached to the key mount. The key may include a key blade, a key head connected to the key blade, the key head having an edge, a head aperture in the key head spaced apart from the edge, the key head including a ramp and two guide ridges, and the ramp being between the two guide ridges. The key may include a key blade, a key head connected to the key blade, the key head having an edge and a head aperture, the head aperture including a notch in the edge. The key may include a ridge over at least a part of the edge, and the ridge may be configured for receiving the first or second key mounting plate. The notch in the key head may be configured for sliding of the mounting post across the notch into the head aperture.

The housing in the key organizing device may include spaced-apart first and second housing base walls respectively having first and second interior surfaces facing each other in the cavity, and the slider may include first and second glide plates respectively contacting the first and second interior surfaces, where the slider is configured for gliding on the first and second glide plates over the first and second interior surfaces.

The key organizing device may include two first interior walls spaced apart on the first interior surface and projecting toward the second interior surface, the first interior walls guiding the slider along a path in the longitudinal direction in alignment with the slider opening. The key organizing device may include two second interior walls spaced apart on the second interior surface and projecting toward the first interior surface, the second interior walls guiding the slider along a path in the longitudinal direction in alignment with the slider opening.

Each of the first interior walls in the key organizing device may include a first interior wall edge facing one of the second interior walls, and each of the second interior walls may include a second interior wall edge spaced apart by a gap from and facing one of the first interior walls. The slider in the key organizing device may include a guide projection configured to glide along at least one of the first interior wall edges in the gap. The slider may include a tensioning member configured to press the guide projection against the at least one first interior wall edge. The at least one first interior wall edge in the key organizing device may include a notch configured for receiving the guide projection. The slider opening in the key organizing device may define key-retracted and key-extended end-positions for the path of the slider, and the notch may be located at a notch point along the first interior wall edge configured for reversibly locking the slider in an end-position. The finger pad of the slider in the key organizing device may be configured for pushing the guide projection out of the notch upon depression of the finger pad toward the housing. The tensioning member may include a spring element. The tensioning member may be interposed between the key mount and the finger pad. The tensioning member may be configured for compression between the finger pad and the key mount upon depression of the finger pad toward the housing. The slider may include a finger pad guiding member configured for guiding the finger pad in a fixed path upon depression of the finger pad toward the housing. The key organizing device may include a pin protruding from the key mount, the pin defining the fixed path.

The slider may include a guide projection configured to glide along a surface of at least one of the first or second interior walls. The two interior walls on the first or second interior surface may be spaced apart at a distance configured to press the guide projection between the two interior walls. The at least one of the interior walls may include a notch configured for receiving the guide projection. The slider opening may define key-retracted and key-extended end-positions for the path of the slider, and the notch may be positioned at a point along the at least one of the interior walls for reversibly locking the slider in an end-position. The finger pad may be configured for pushing the guide projection out of the notch upon deflection of the finger pad. The slider opening of the key organizing device may include at least two wide regions spaced apart along the longitudinal direction respectively allowing the guide projection to enter the notch at the key-retracted and key-extended end-positions, and at least one narrow region between the key-retracted and key-extended end-positions constraining the guide projection away from the at least one of the interior walls.

The slider opening of the key organizing device may be configured so that at a first point along the longitudinal direction the key mount can pass through the slider opening, and so that at a second point along the longitudinal direction the key mount cannot pass through the slider opening. The slider opening may include a slot edge, and may include a slider dampener on the slot edge. The slider dampener may include a resilient layer. The slider dampener may be configured for gripping the slider. The slider opening may be configured at a first point along the longitudinal direction so that the key mount can pass through the slider opening at the first point, and may be configured at a second point along the longitudinal direction so that the slider dampener grips the slider at the second point.

The key organizing device may include a key dampener at the end opening, the key dampener including a key slot configured for sliding engagement of a key blade. The key slot may have two spaced apart slot surfaces configured for sliding engagement of a key blade, the key slot also including two flexible slot ends.

The cover of the key organizing device may include a bezel having two spaced-apart tabs engaging the housing for removable attachment of the cover over the end opening. The key organizing device may include first and second housing elements configured for together forming the housing, each of the housing elements having a housing base wall, the slider opening being located in a housing base wall. Each of the first and second housing elements may include an end wall, and the end walls may be joined by a hinge and may together form the back wall.

The finger pad of the slider of the key organizing device may include a key identifier. The key identifier may include an identifier selected from a raised rib, a raised dot, a colored marker, or more than one of the foregoing.

The key organizing device may include key mounting plates having inside surfaces tapered in conformance with tapered ramps on the head of a key. The key mounting plates may be configured for resting against stop ridges on a key, and sliding over the tapered ramps and placing frontal edges of the key mount in contact with the stop ridges.

In another example of an implementation, a key is provided. The key includes a key blade, and a key head connected to the key blade. The key head has an edge. The key includes a head aperture located in the key head and spaced apart from the edge. The key head includes a ramp and two guide ridges. The ramp is between the two guide ridges. In examples, the key may further include one or more of the following features.

The head aperture may be configured for receiving a mounting post, and the key head may be configured for guiding the mounting post into and out of the head aperture. The key may be configured for removable attachment to a key mount including a mounting post and spaced-apart first and second key mounting plates, where the mounting post is on the first key mounting plate and projecting toward the second key mounting plate. The head aperture may be set in the ramp, and the key head may be configured for sliding of the key mounting plates over the ramp between the guide ridges.

A key is provided as a further example of an implementation, the key including a key blade, and a key head connected to the key blade. The key head has an edge and a head aperture. The head aperture includes a notch in the edge. In examples, the key may further include one or more of the following features.

The head aperture may be configured for receiving a mounting post of a key mount, and the key head may be configured for guiding the mounting post into and out of the head aperture. The key may be configured for removable attachment to a key mount including a mounting post and spaced-apart first and second key mounting plates, where the mounting post is on the first key mounting plate and projects toward the second key mounting plate. The key may include a ridge over at least a part of the edge, where the ridge is configured for receiving the first or second key mounting plate of a key mount. The notch may be configured for sliding of the mounting post across the notch into the head aperture.

In a further example of an implementation, a key is provided. The key includes a key blade, and a key head connected to the key blade. The key head has an edge and two sides. The key includes a head aperture located in the key head and spaced apart from the edge. The key head includes a tapered ramp on each side, the tapered ramp narrowing toward the edge in a direction passing through the head aperture.

The head aperture may be configured for receiving a mounting post, and the key head may be configured for guiding the mounting post into and out of the head aperture. The key may be configured for removable attachment to a key mount including a mounting post and spaced-apart first and second key mounting plates, where the mounting post is on the first key mounting plate and projecting toward the second key mounting plate, and where each of the first and second key mounting plates is configured for resting over a tapered ramp. The key may include first and second stop ridges. The tapered ramps may terminate at the stop ridges.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION

Key organizing devices, and keys, are provided. In an example, an implementation of a key organizing device includes a housing, a cover, and a slider. The housing includes a cavity, two housing ends, an end opening, a back wall, and a slider opening. The two housing ends are spaced apart in a longitudinal direction. The end opening is located at one of the housing ends. The back wall is located at the other housing end. The slider opening extends in the longitudinal direction. The cover is removeably attached over the end opening. The slider includes a finger pad and a key mount. The key mount is positioned inside the cavity and connected to the finger pad through the slider opening. The slider is configured for attachment and detachment of a key through the end opening upon removal of the cover.

Figure 1:
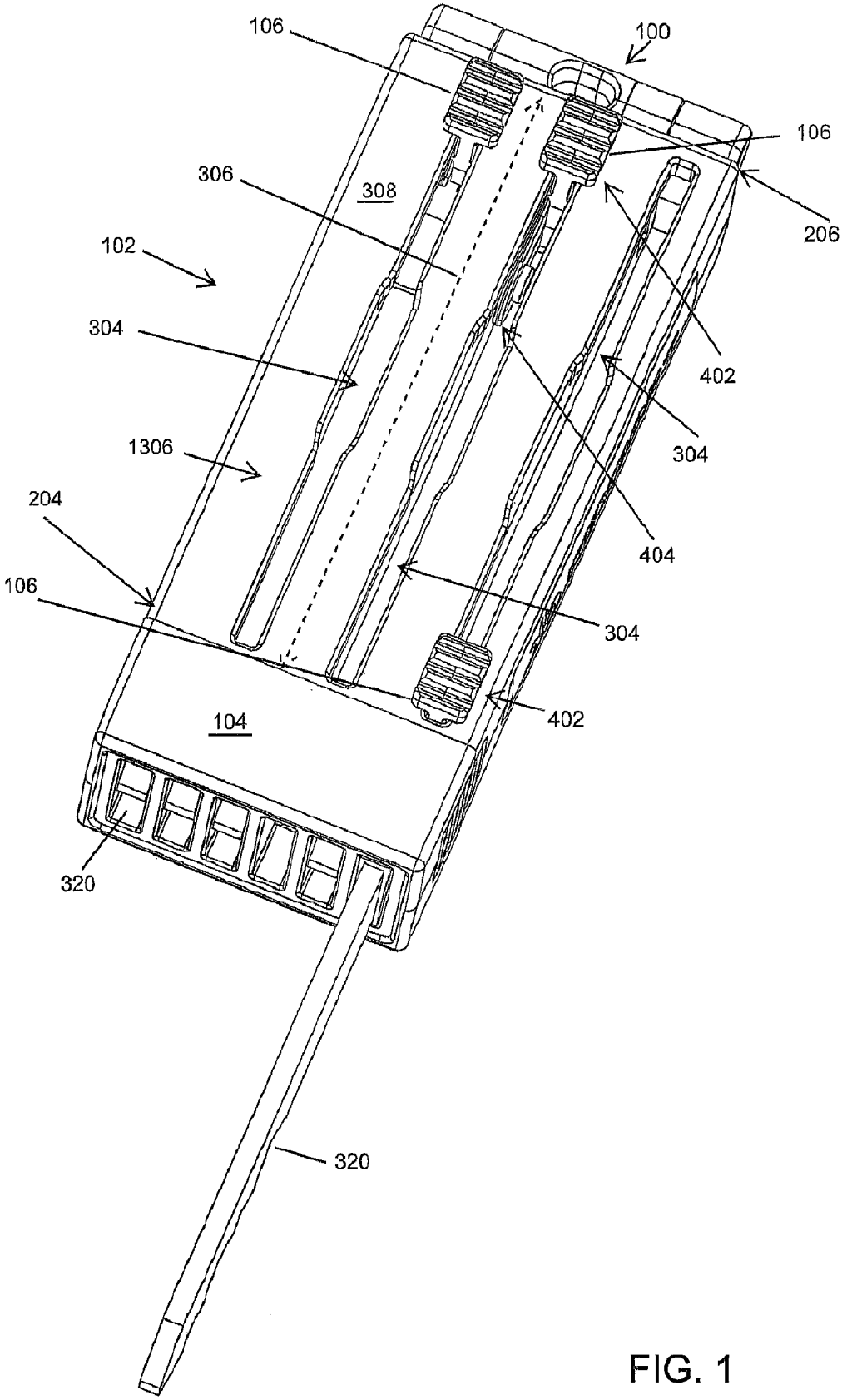
FIG. 1 is a perspective view showing an example of an implementation of a key organizing device.

FIG. 1 is a perspective view showing an example of an implementation of a key organizing device 100. The key organizing device 100 includes a housing 102, a cover 104, and an example 106 of a slider.

Figure 2:
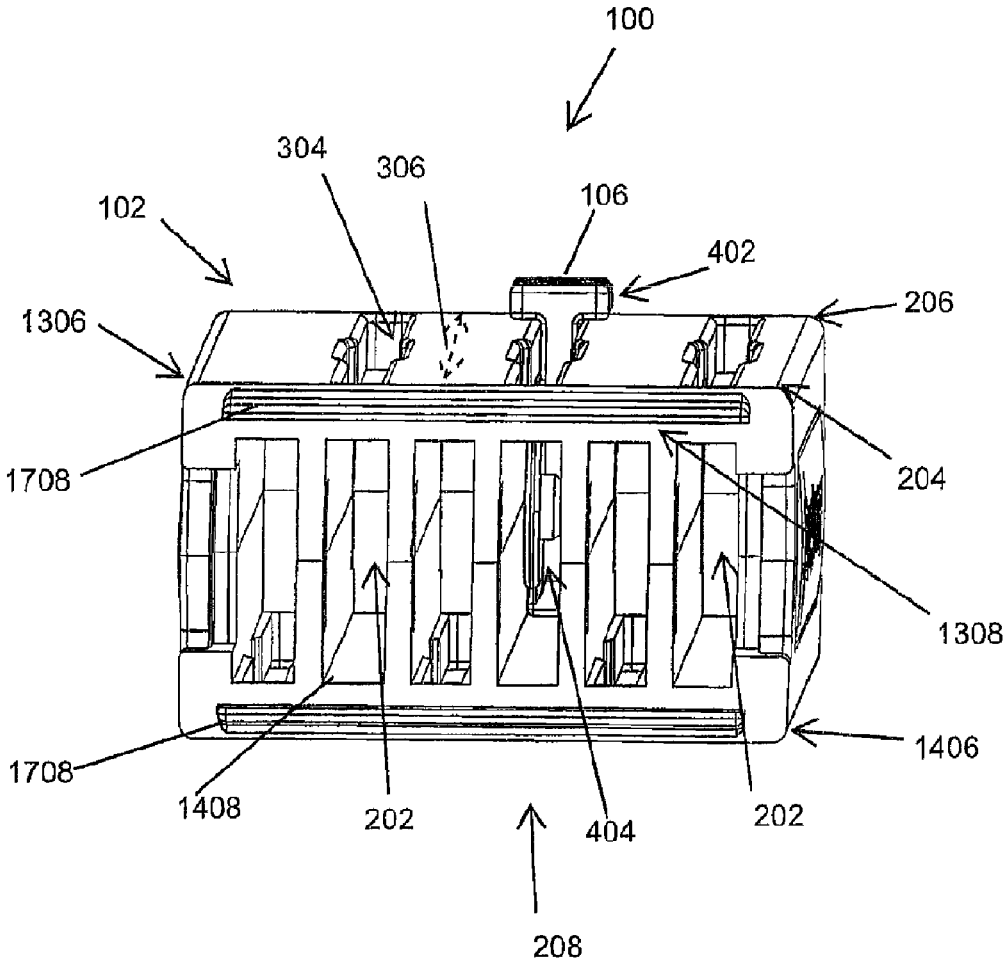
FIG. 2 is another perspective view of the key organizing device shown in FIG. 1

FIG. 2 is another perspective view of the key organizing device 100 shown in FIG. 1, after removal of the cover 104 and showing only one of the examples 106 of sliders. The housing 102 includes a cavity 202, two housing ends 204, 206, and an end opening 208.

Figure 3:
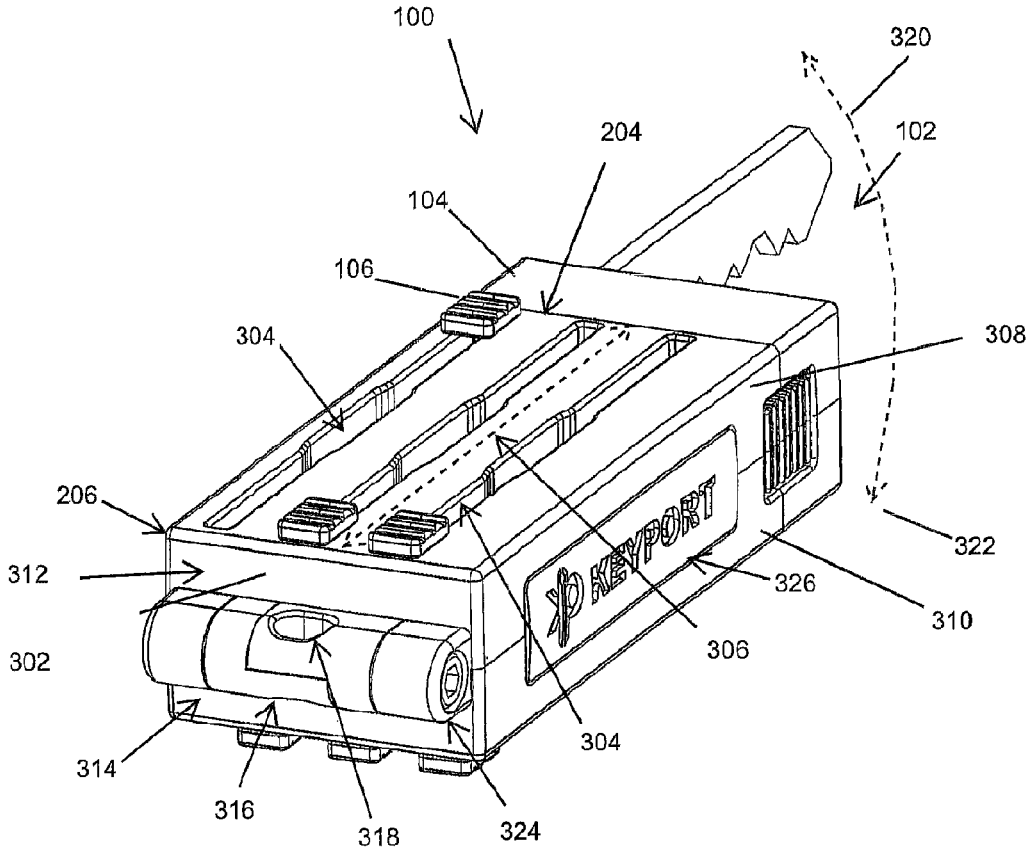
FIG. 3 is an additional perspective view of the key organizing device shown in FIG. 1.

FIG. 3 is an additional perspective view of the key organizing device 100 shown in FIG. 1. The key organizing device further includes a back wall 302, and a slider opening 304.

The two housing ends 204, 206 of the key organizing device 100 are spaced apart in a longitudinal direction indicated by the arrow 306. The end opening 208 is located at one of the housing ends 204. The back wall 302 is located at the other housing end 206. The slider opening 304 extends in the longitudinal direction indicated by the arrow 306.

The key organizing device 100 may, for example, include a first housing element 308 and a second housing element 310, together configured to form the housing 102. The first housing element 308 may include an end wall 312, and the second housing element 310 may include an end wall 314. The end walls 312, 314 may be joined by a hinge 316 and may together form the back wall 302. The hinge may include a slot 318 for utilization in attaching the key organizing device 100 to other fixed or moveable objects.

Figure 4:
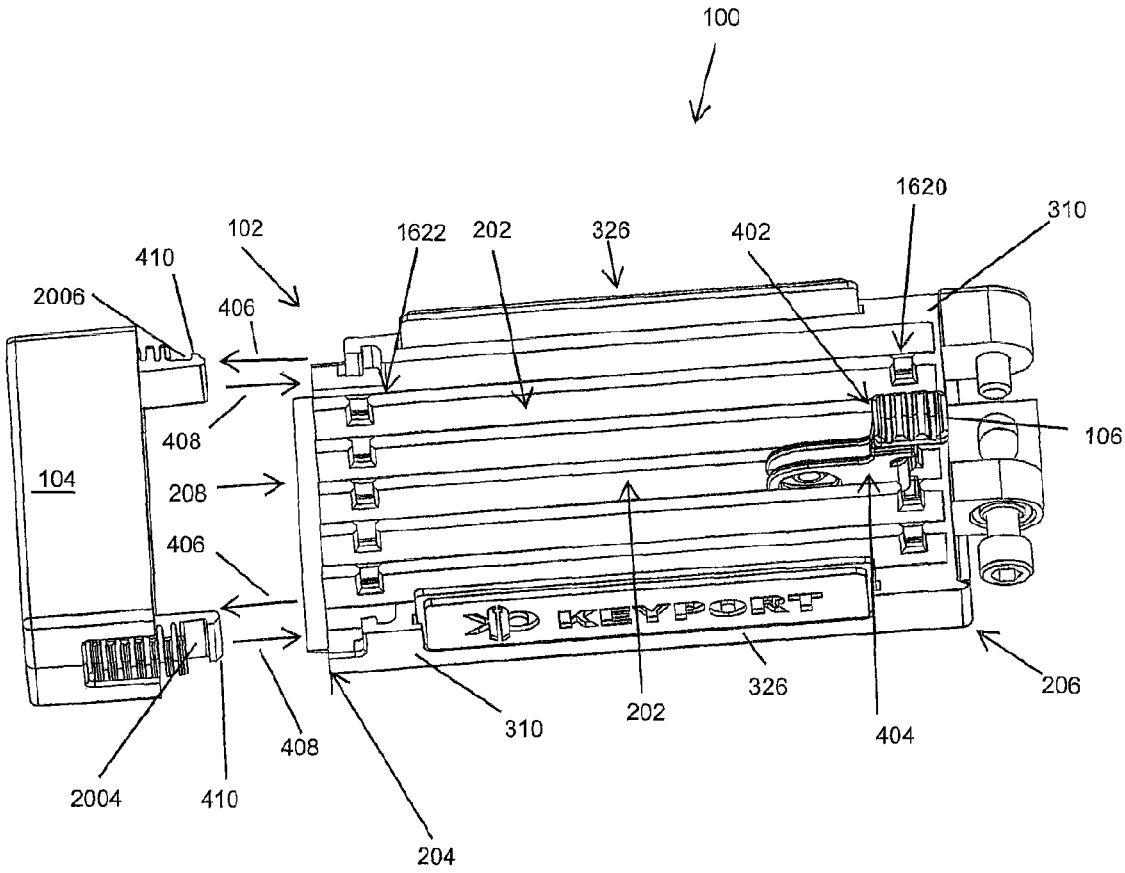
FIG. 4 is a further perspective view showing an example of the key organizing device shown in FIG. 1.

FIG. 4 is a further perspective view showing an example of the key organizing device 100 shown in FIG. 1, where the housing 102 includes a second housing element 310, with the first housing element 308 removed to expose parts of the cavity 202, and an example 106 of a slider. The example 106 of a slider includes a finger pad 402 and a key mount 404. The finger pad 402 may have a plurality of raised ribs for friction engagement of a thumb or finger to move the example 106 of a slider in longitudinal directions of the arrow 306. In examples, the finger pad 402 may include a key identifier (not shown) for identifying a key 320. The key identifier may include, as examples, a selected number of raised ribs, a selected number of raised dots, a colored marker, or more than one of the foregoing.

FIG. 4 illustrates that the cover 104 may be removed in the directions of the arrows 406 from the end opening 208, and may be attached over the end opening 208 in the directions of the arrows 408. The key mount 404 is positioned inside the cavity 202 and is connected to the finger pad 402 through the slider opening 304. Referring to FIG. 3, the first and second housing elements 308, 310 may be separated to expose the cavity 202 after removal of the cover 104 by swinging the first and second housing elements 308, 310 apart on the hinge 316 in the directions of the arrow 322.

Figure 5:
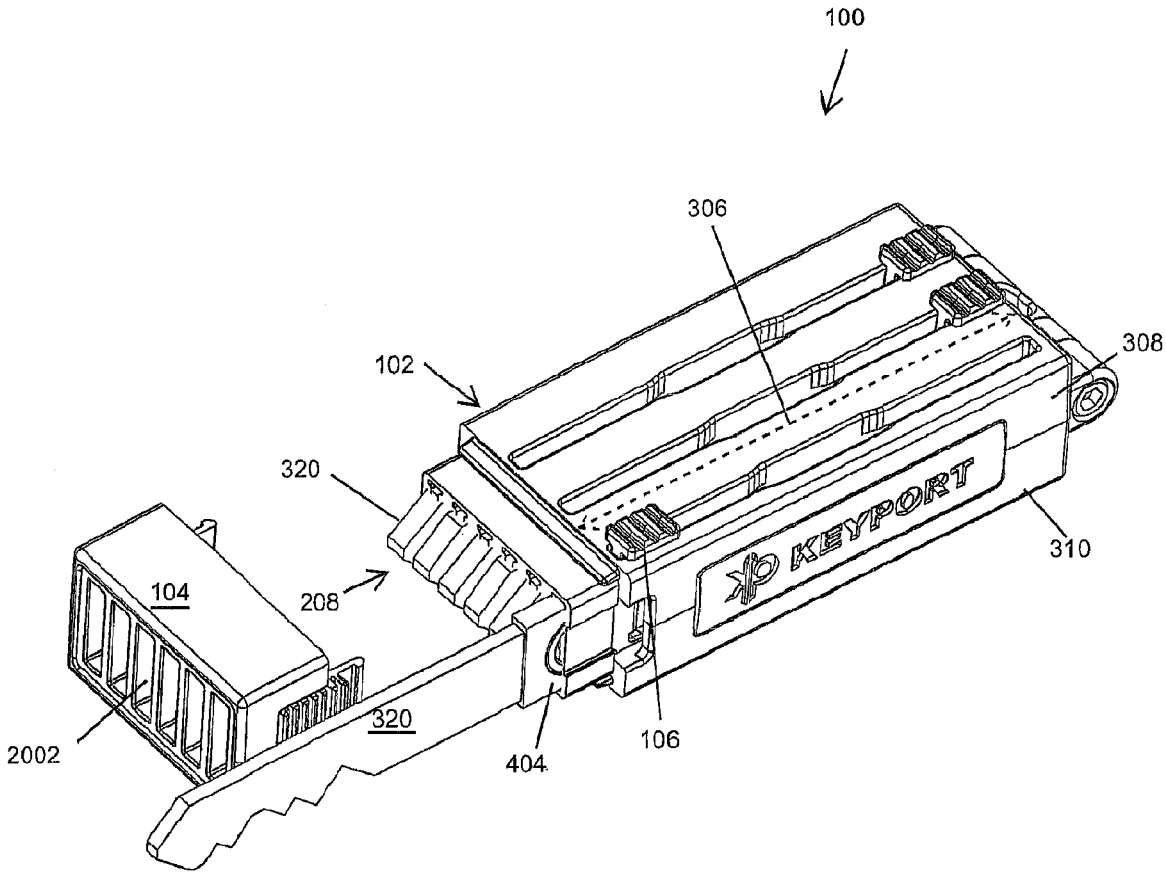
FIG. 5 is a further perspective view of the key organizing device shown in FIG. 1.

FIG. 5 is a further perspective view of the key organizing device 100 shown in FIG. 1, after removal of the cover 104. FIG. 5 shows a plurality of keys 320 mounted in the key organizing device 100. One of the examples 106 of sliders in FIG. 5 has been moved in the longitudinal direction indicated by the arrow 306 to a fully extended position, exposing the key mount 404 to which a key 320 is attached. FIG. 5 illustrates that the example 106 of a slider is configured for attachment and detachment of a key 320 through the end opening 208 upon removal of the cover 104.

Figure 6:
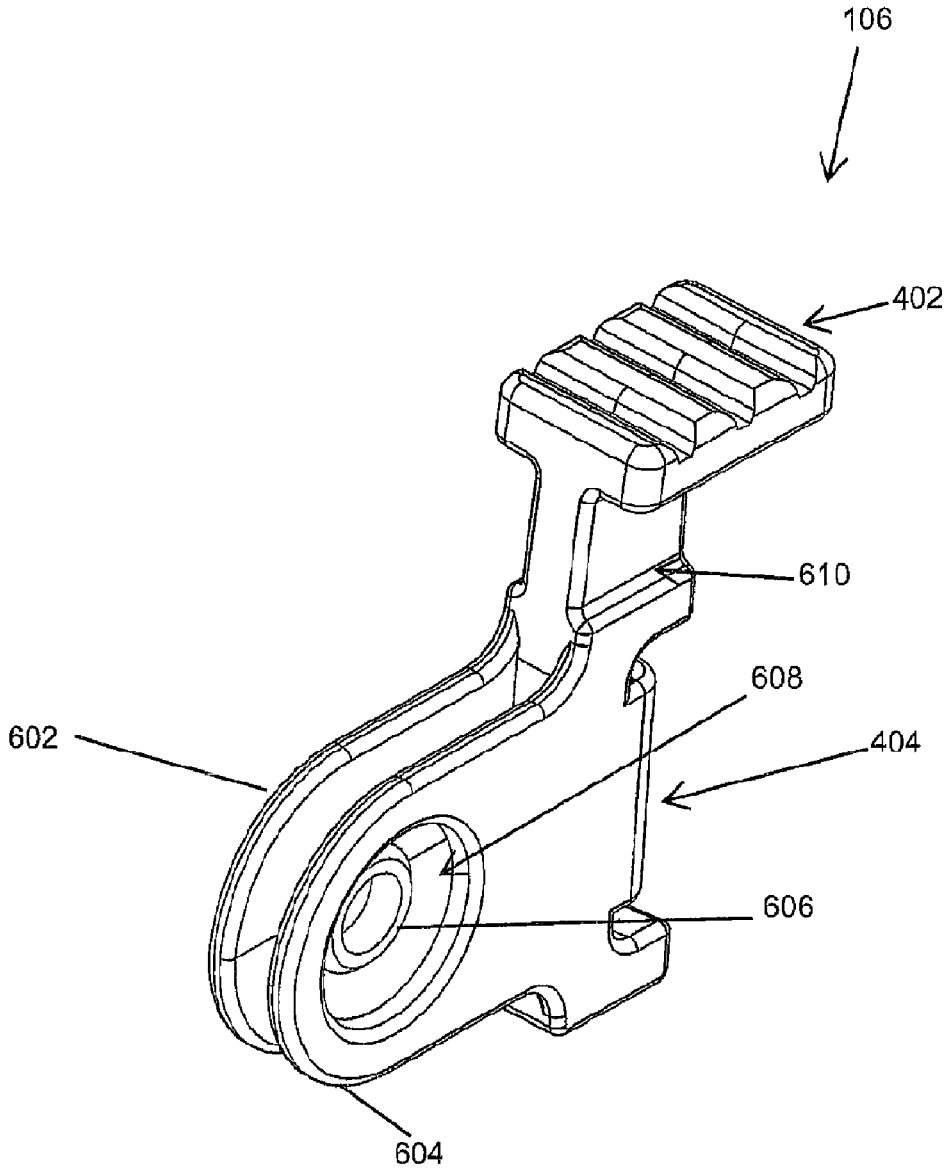
FIG. 6 is a perspective view showing an example of a slider.

FIG. 6 is a perspective view showing an example 106 of a slider. The example 106 of a slider includes a finger pad 402 and a key mount 404. The key mount 404 includes spaced-apart first and second key mounting plates 602, 604. The first key mounting plate 602 has a mounting post 606. The second key mounting plate 604 may include a plate opening 608 in spaced-apart alignment with the mounting post 606.

Figure 7:
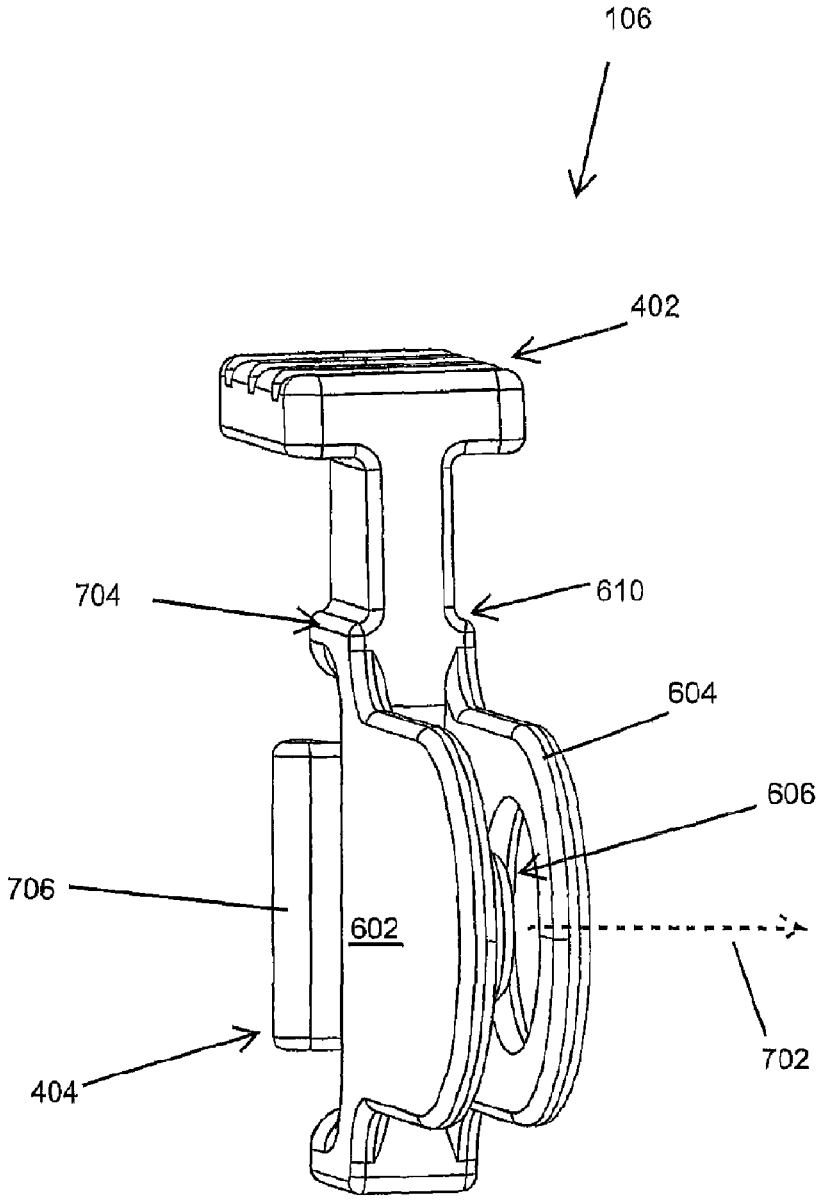
FIG. 7 is another perspective view of the example of a slider shown in FIG. 6.

FIG. 7 is another perspective view of the example 106 of a slider shown in FIG. 6. FIGS. 6 and 7 illustrate that the mounting post 606 projects in the direction of the arrow 702 toward the second key mounting plate 604.

Figure 8:
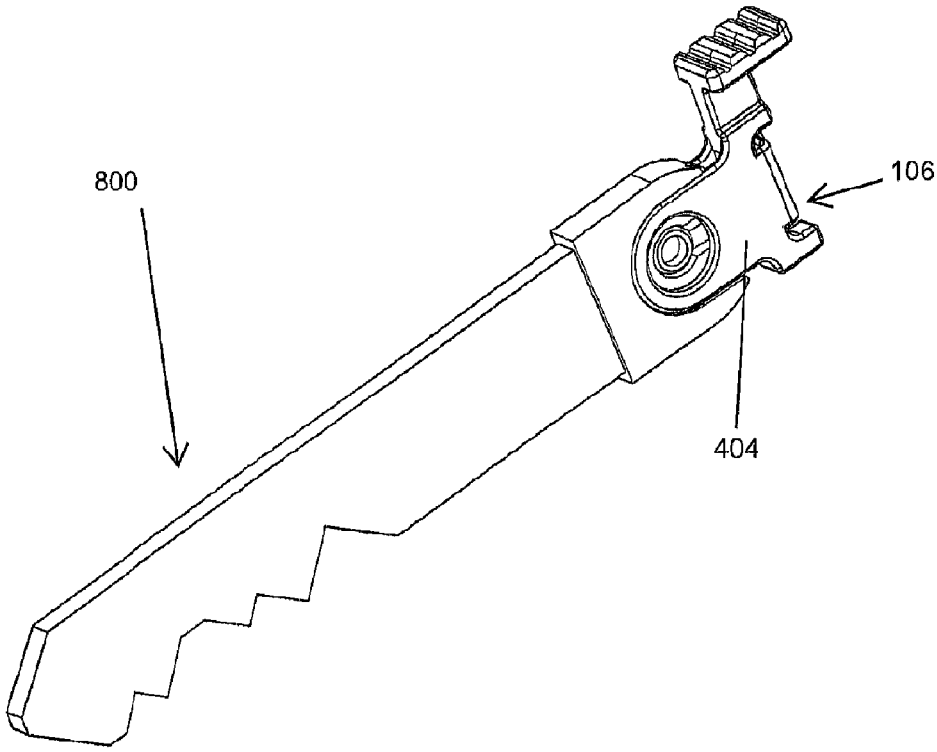
FIG. 8 is a perspective view showing an example of an implementation of a key attached to the slider shown in FIG. 6.

FIG. 8 is a perspective view showing an example of an implementation of a key 800. The key 800 may be utilized as the key 320 discussed earlier, removeably attached to the key mount 404 of the example 106 of a slider shown in FIG. 6.

Figure 9:
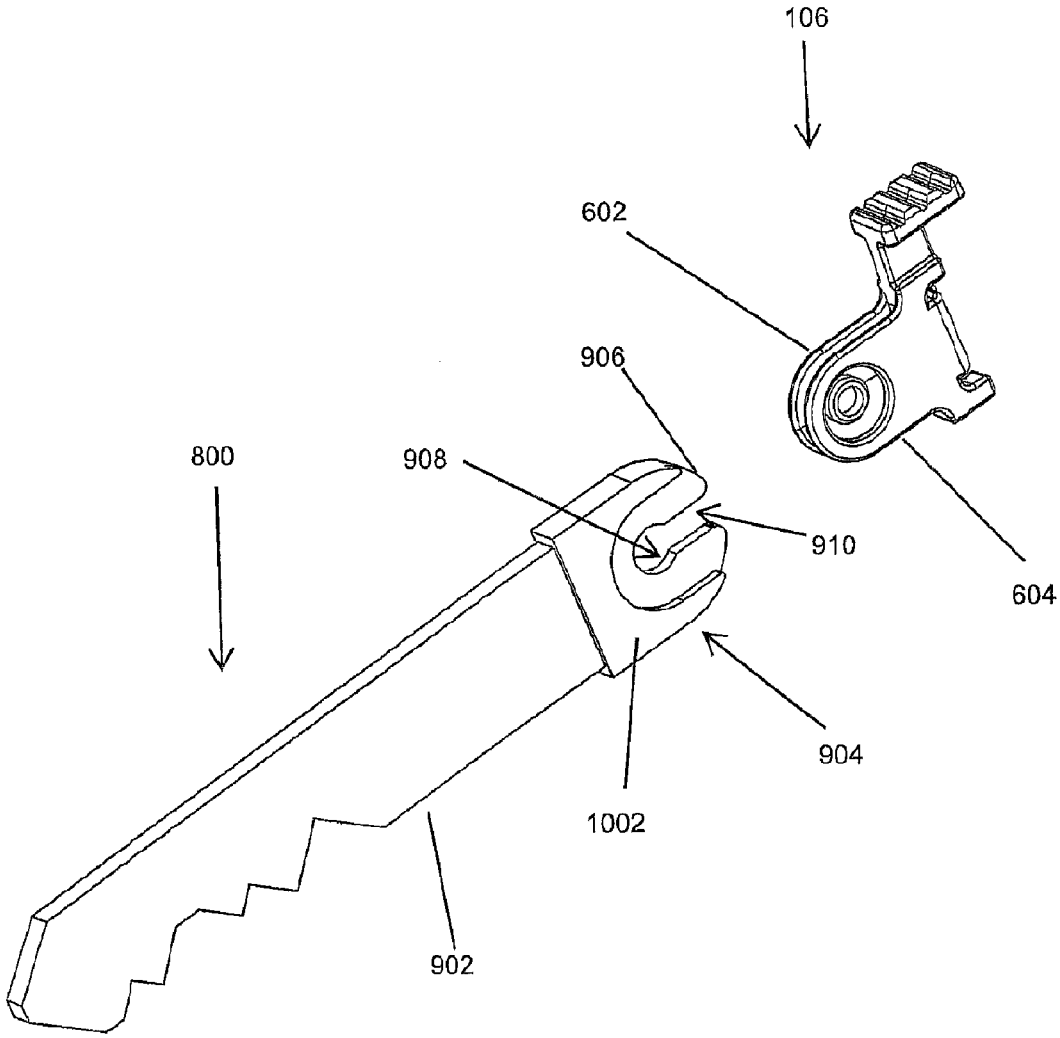
FIG. 9 is another perspective view of the key shown in FIG. 8, and the slider shown in FIG. 6.

FIG. 9 is another perspective view of the key 800 shown in FIG. 8, detached from the example 106 of a slider shown in FIG. 6. The key 800 includes a key blade 902, and a key head 904 connected to the key blade 902. The key head 904 has an edge 906 and a head aperture 908. The head aperture 908 includes a notch 910 in the edge 906.

Figure 10:
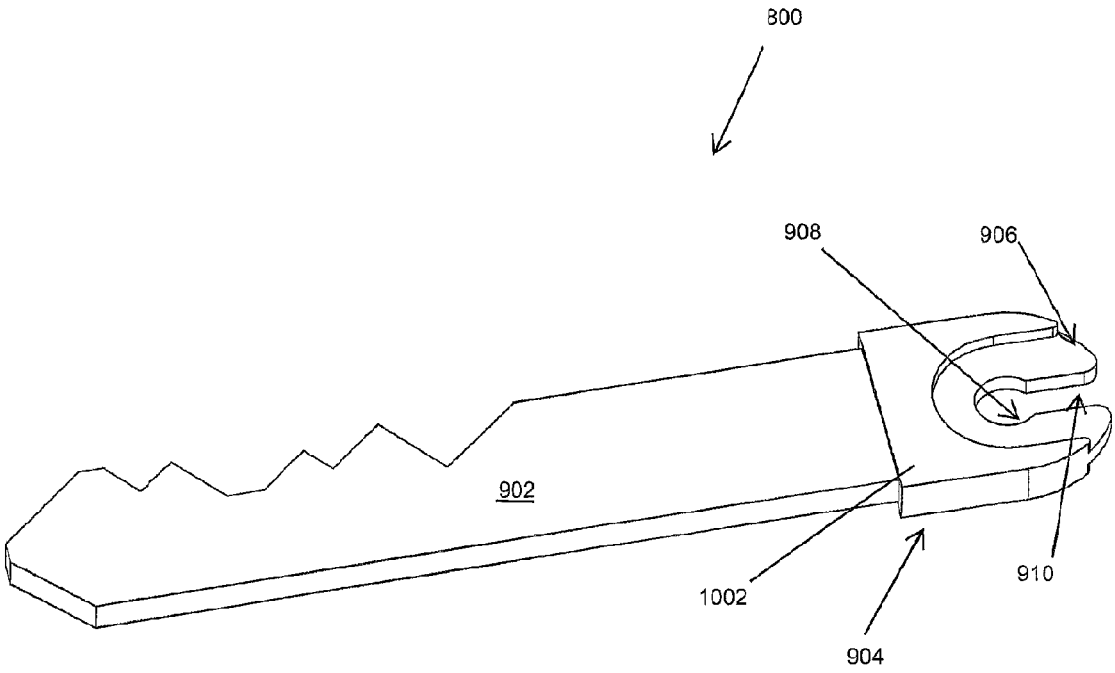
FIG. 10 is a further perspective view of the key shown in FIG. 8.

FIG. 10 is a further perspective view of the key 800 shown in FIG. 8. In an example, the key 800 may include a ridge 1002 over at least a part of the edge 906, and the ridge 1002 may be configured for receiving the first or second key mounting plate 602, 604 of the example 106 of a slider.

Figure 11:
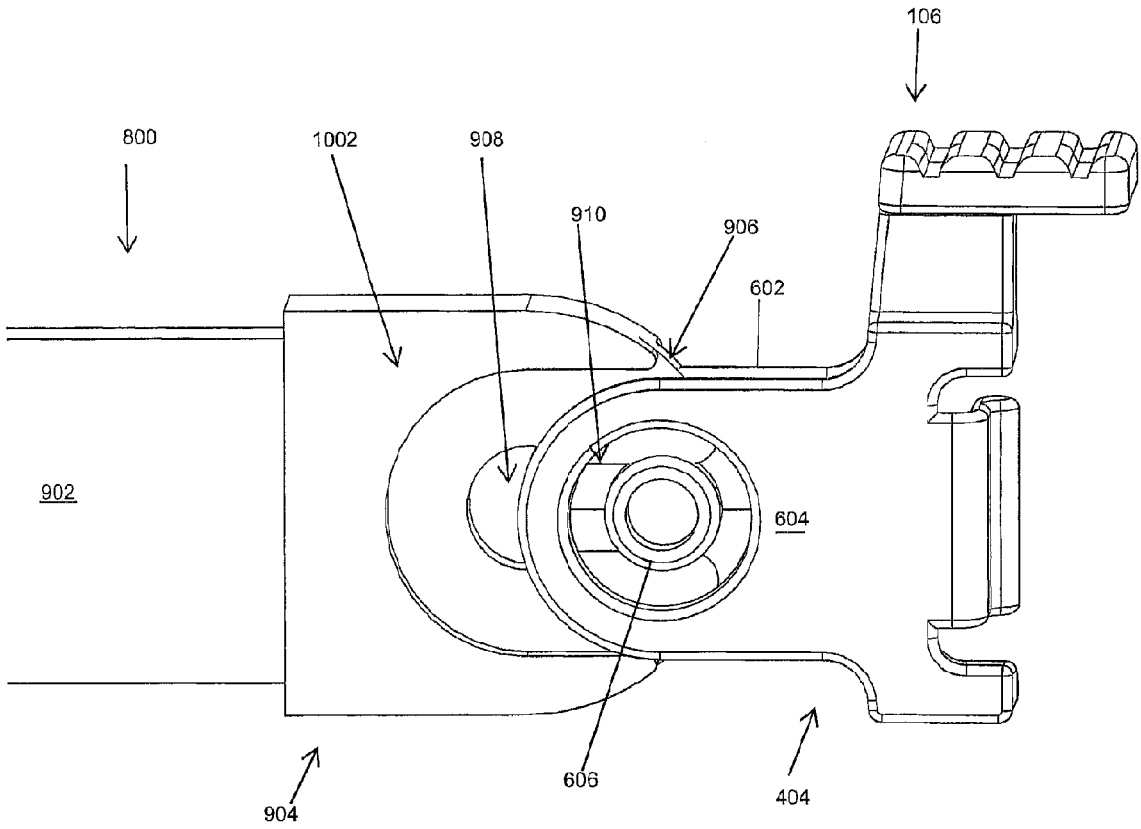
FIG. 11 is side view showing part of the key shown in FIG. 8, and the slider shown in FIG. 6

FIG. 11 is side view showing part of the key 800 shown in FIG. 8, partially attached to the example 106 of a slider shown in FIG. 6. As an example, the notch 910 in the key head 904 may be configured for sliding of the mounting post 606 across the notch 910 into the head aperture 908. In this example, the ridge 1002 configured for receiving either or both of the first and second key mounting plates 602, 604 cooperates with the notch 910 configured for sliding the mounting post 606 across the notch 910 into the head aperture 908, in guiding the mounting post 606 into and out of the head aperture 908 and in guiding the key head 904 into and out of the key mount 404.

Figure 12:
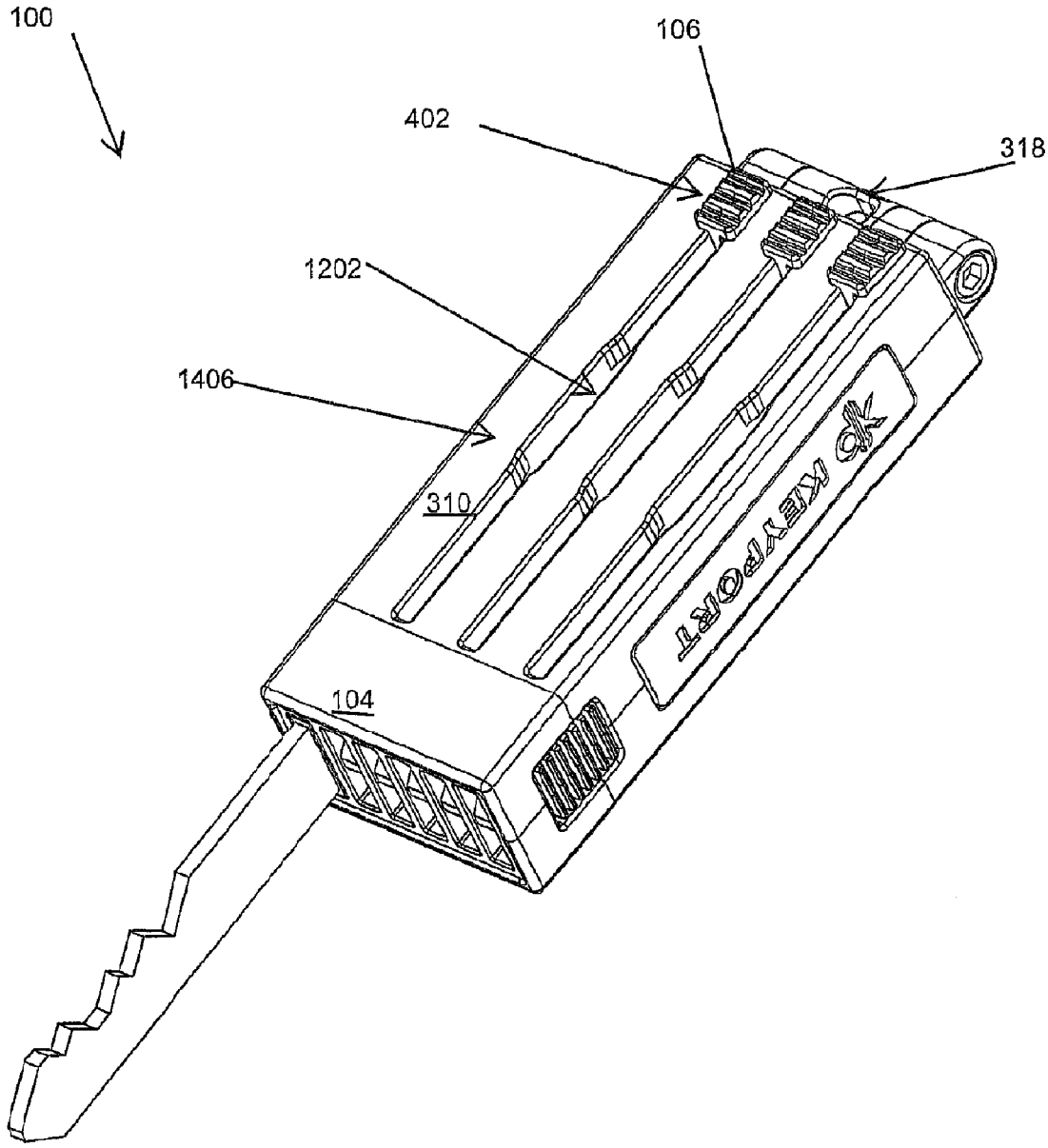
FIG. 12 is another perspective view of an example of the key organizing device shown in FIG. 1.

FIG. 12 is another perspective view of an example of the key organizing device 100 shown in FIG. 1. FIG. 12 illustrates the second housing element 310 and the finger pads 402 of three examples 106 of sliders protruding through slider openings 1202. Referring to FIGS. 1, 4 and 12, the key organizing device 100 may, as an example, include three examples 106 of sliders having finger pads 402 protruding through slider openings 304 in the first housing element 308, and three examples 106 of sliders having finger pads 402 protruding through slider openings 1202 in the second housing element 310. In additional examples of the key organizing device 100 (not shown), a selected quantity of examples 106 of sliders, such as a quantity of examples 106 of sliders within a range of between one example 106 of a slider and ten examples 106 of sliders, may have finger pads 402 protruding through slider openings 304 in the first housing element 308. As further examples of the key organizing device 100 (not shown), a selected quantity of examples 106 of sliders, such as a quantity of examples 106 of sliders within a range of between one example 106 of a slider and ten examples 106 of sliders, or no examples 106 of sliders as another example, may have finger pads 402 protruding through slider openings 1202 in the second housing element 310.

Figure 13:
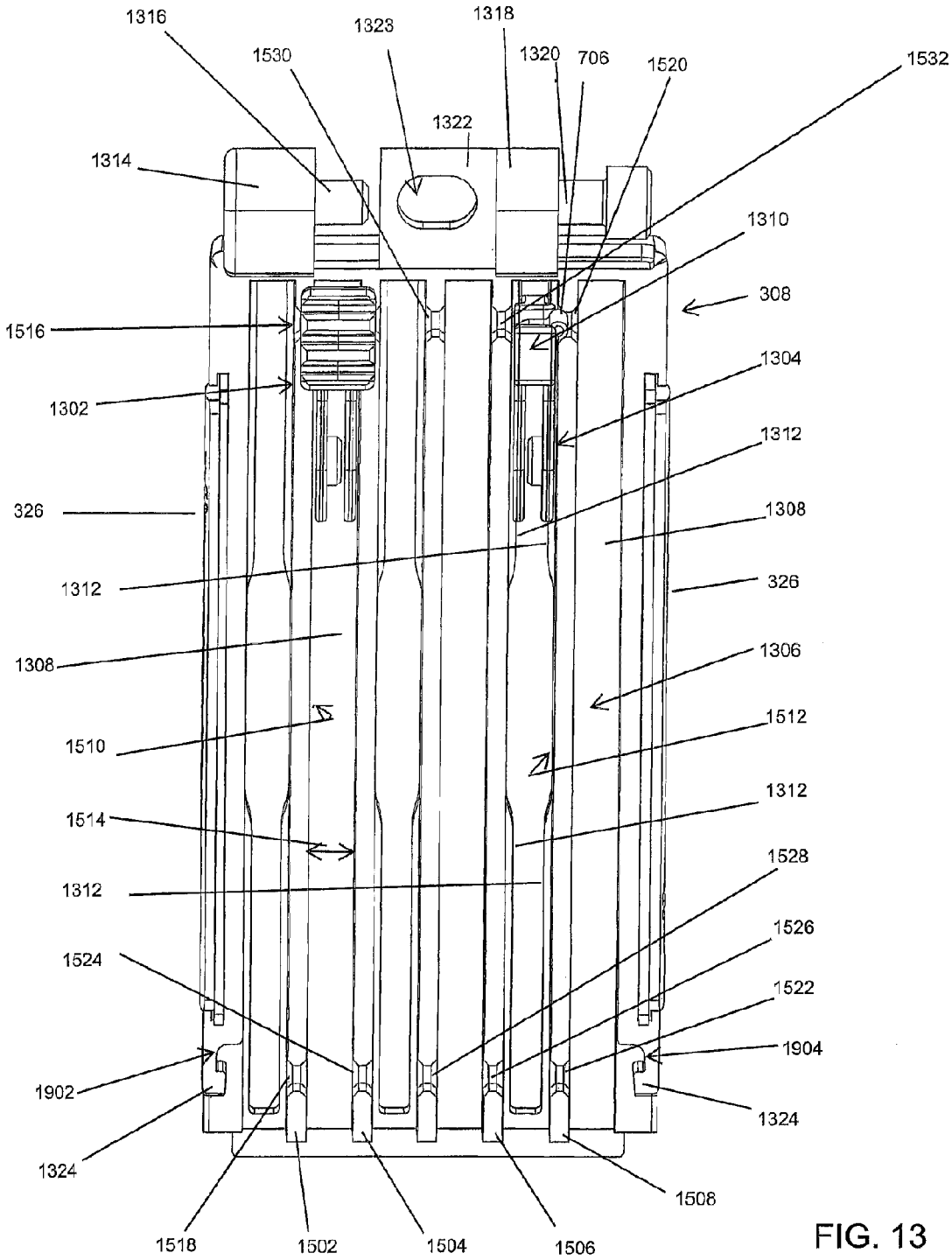
FIG. 13 is an interior view of an example of a first housing element including two examples of sliders, with other elements of the key organizing device shown in FIG. 1 having been removed.

FIG. 13 is an interior view of an example of a first housing element 308. The first housing element 308 includes two examples 1302, 1304 of sliders, with other elements of the key organizing device 100 shown in FIG. 1 having been removed.

Figure 14:
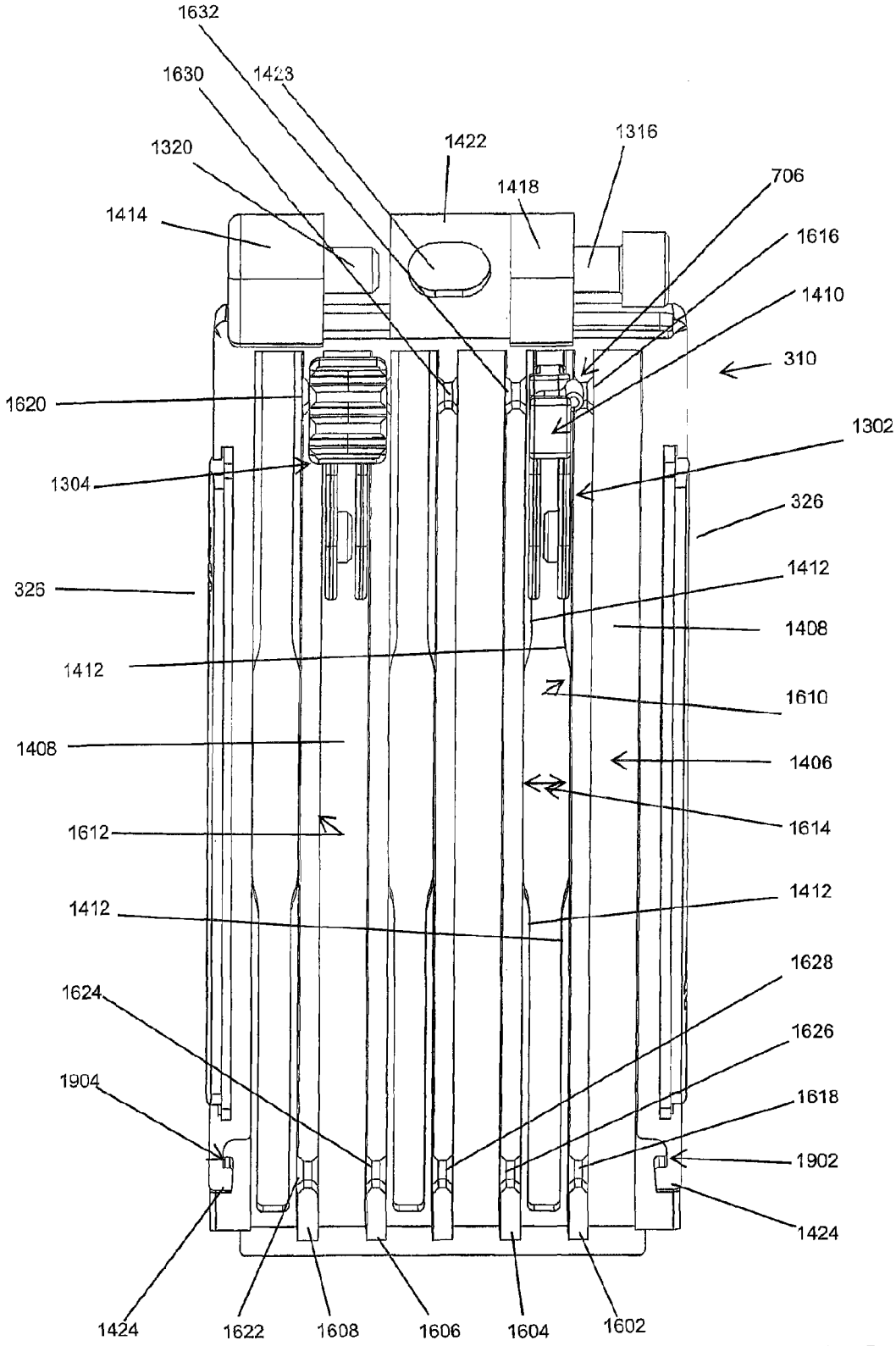
FIG. 14 is an interior view of an example of a second housing element including the same two examples of sliders, with other elements of the key organizing device shown in FIG. 1 having been removed.

FIG. 14 is an interior view of an example of a second housing element 310 including the same two examples 1302, 1304 of sliders, with other elements of the key organizing device 100 shown in FIG. 1 having been removed. The first housing element 308 of the housing 102 includes a first housing base wall 1306 having a first interior surface 1308 in the cavity 202. The second housing element 310 of the housing 102 includes a second housing base wall 1406 having a second interior surface 1408 in the cavity 202. Referring to FIG. 2, the first and second interior surfaces 1308, 1408 face each other in the cavity 202.

Referring to FIGS. 6, 7, 13 and 14, the examples 1302, 1304 of sliders may each include first glide plates 610, 704 and second glide plates 1310, 1410. The first glide plates 610, 704 of the example 1302 of a slider may contact exposed slot edges 1412 of the second interior surface 1408. The first glide plates 610, 704 of the example 1304 of a slider may contact exposed slot edges 1312 of the first interior surface 1308.

The second glide plate 1410 of the example 1302 of a slider may contact the first interior surface 1308. The second glide plate 1310 of the example 1304 of a slider may contact the second interior surface 1408. The examples 1302, 1304 of sliders may accordingly be configured for gliding on the first glide plates 610, 704 and second glide plates 1310, 1410 over the first and second interior surfaces 1308, 1408.

The first housing element 308 may include a first hinge element 1314 having a recessed aperture (not shown) for a bolt 1316, a second hinge element 1318 having an aperture (not shown) for a bolt 1320, and a ring plate 1322. The second housing element 310 may include a first hinge element 1414 having a recessed aperture (not shown) for the bolt 1320, a second hinge element 1418 having an aperture (not shown) for the bolt 1316, and a ring plate 1422. Upon assembly of the first and second housing elements 308, 310 to form the housing 102, the bolt 1316 may be inserted into the first hinge element 1314 and the second hinge element 1418, and the bolt 1320 may be inserted into the first hinge element 1414 and the second hinge element 1318. The bolts 1316, 1320 may be threaded (not shown) and may have hex-recess drive heads 324. The ring plates 1322, 1422 may have apertures 1323, 1423 respectively, together forming the slot 318. In another example (not shown) the first and second hinge elements 1314, 1318, 1414, 1418 may be omitted, and the first and second housing elements 308, 310 may be adhered together, such as by ultrasonic welding or a suitable adhesive composition.

Figure 15:
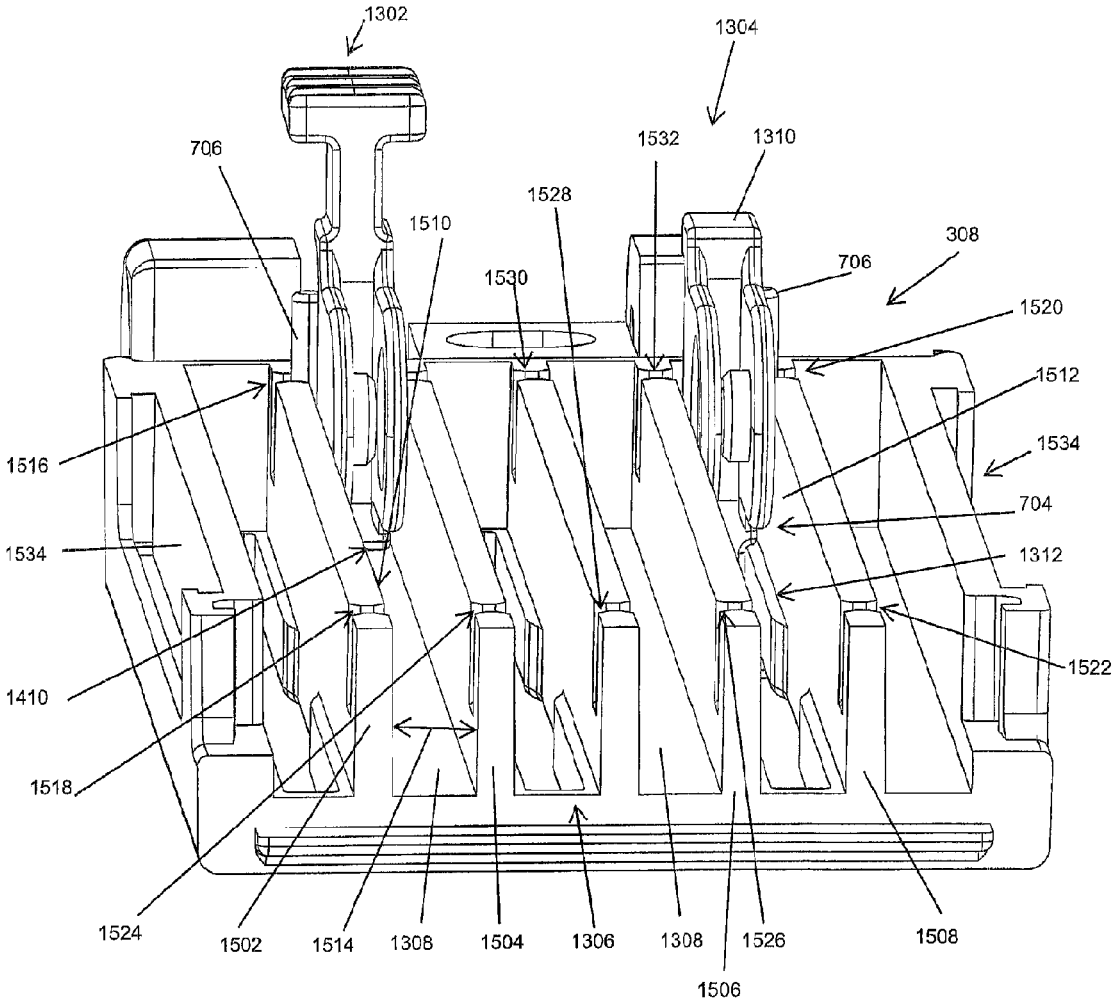
FIG. 15 is another interior view of the example shown in FIG. 13 of the first housing element including the two examples of sliders, with other elements of the key organizing device shown in FIG. 1 having been removed.
Figure 16:
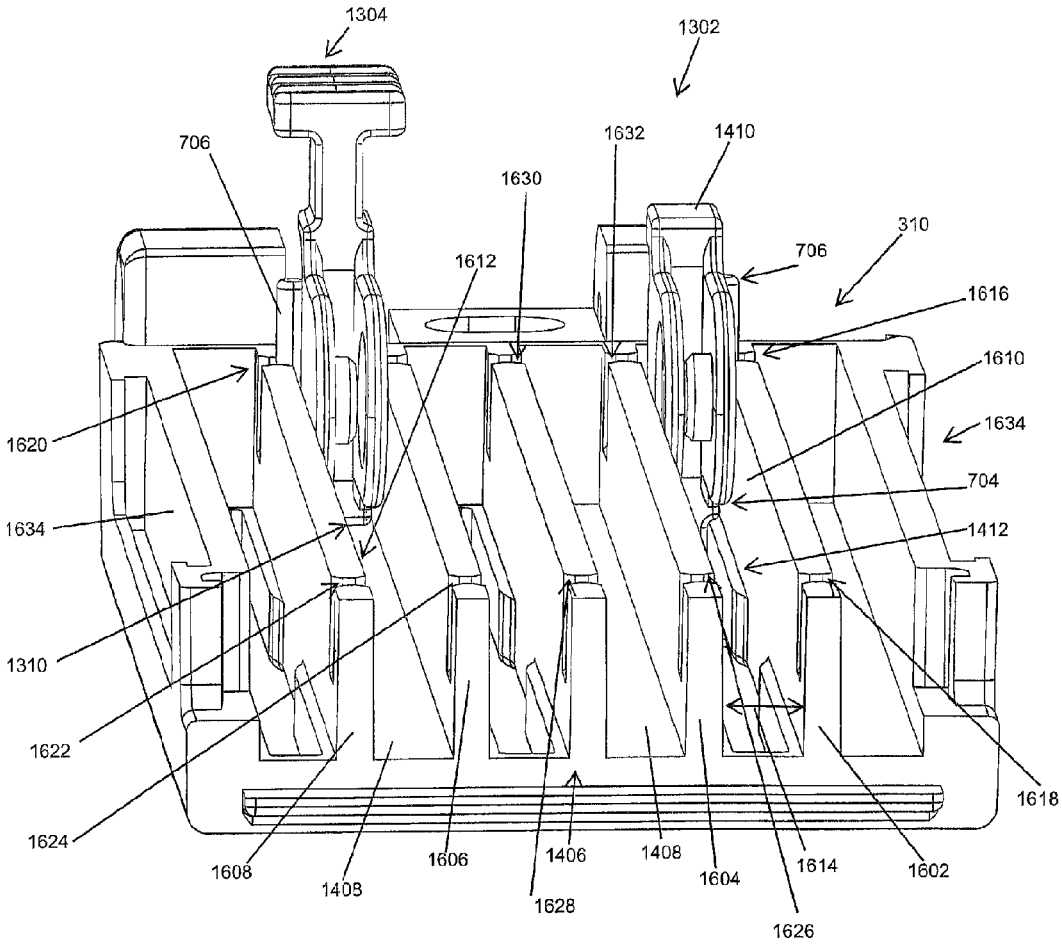
FIG. 16 is another interior view of the example shown in FIG. 14 of the second housing element including the same two examples of sliders, with other elements of the key organizing device shown in FIG. 1 having been removed.

FIG. 15 is another interior view of the example shown in FIG. 13 of the first housing element 308 including the two examples 1302, 1304 of sliders, with other elements of the key organizing device 100 shown in FIG. 1 having been removed. FIG. 16 is another interior view of the example shown in FIG. 14 of the second housing element 310 including the same two examples 1302, 1304 of sliders, with other elements of the key organizing device 100 shown in FIG. 1 having been removed.

The first interior surface 1308 of the first housing base wall 1306 may, for example, have two first interior walls 1502, 1504 spaced apart on the first interior surface 1308 and projecting toward the second interior surface 1408 of the second housing base wall 1406, the first interior walls 1502, 1504 guiding the example 1302 of a slider along a path in the longitudinal direction of the arrow 306 in alignment with the slider opening 1202. The second interior surface 1408 of the second housing base wall 1406 may, for example, have two second interior walls 1602, 1604 spaced apart on the second interior surface 1408 and projecting toward the first interior surface 1308 of the first housing base wall 1306, the second interior walls 1602, 1604 guiding the example 1302 of a slider along a path in the longitudinal direction of the arrow 306 in alignment with the slider opening 1202.

In a similar manner, the first interior surface 1308 of the first housing base wall 1306 may, for example, have two first interior walls 1506, 1508 spaced apart on the first interior surface 1308 and projecting toward the second interior surface 1408 of the second housing base wall 1406, the first interior walls 1506, 1508 guiding the example 1304 of a slider along a path in the longitudinal direction of the arrow 306 in alignment with the slider opening 304. The second interior surface 1408 of the second housing base wall 1406 may in a similar manner, for example, have two second interior walls 1606, 1608 spaced apart on the second interior surface 1408 and projecting toward the first interior surface 1308 of the first housing base wall 1306, the second interior walls 1606, 1608 guiding the example 1304 of a slider along a path in the longitudinal direction of the arrow 306 in alignment with the slider opening 304.

Referring to FIGS. 7, 15 and 16, the example 1302 of a slider may include a guide projection 706 configured to glide along a surface 1510 of the first interior wall 1502 or along a surface 1610 of the second interior wall 1602. Further, the example 1304 of a slider may include a guide projection 706 configured to glide along a surface 1512 of the first interior wall 1508 or along a surface 1612 of the second interior wall 1608.

The first interior walls 1502 and 1504 may be spaced apart at a distance defined by the arrow 1514, configured to press the guide projection 706 of the example 1302 of a slider between the first interior walls 1502, 1504. The second interior walls 1602 and 1604 may be spaced apart at a distance defined by the arrow 1614, configured to press the guide projection 706 of the example 1302 of a slider between the second interior walls 1602, 1604. For example, these configurations of the first interior walls 1502, 1504 and of the second interior walls 1602, 1604 may press the guide projection 706 of the example 1302 of a slider against the surface 1510 of the first interior wall 1502 or against the surface 1610 of the second interior wall 1602. The first interior walls 1506, 1508 or the second interior walls 1606, 1608 or all of these four interior walls 1506, 1508, 1606, 1608 may likewise be configured to press the guide projection 706 of example 1304 of a slider between the first interior walls 1506, 1608, or between the second interior walls 1606, 1608, or between all of these four interior walls 1506, 1508, 1606, 1608.

The first interior wall 1502 may include a notch 1516 or a notch 1518 configured for receiving the guide projection 706 of the example 1302 of a slider, or the first interior wall 1502 may include both of the notches 1516, 1518. The second interior wall 1602 may include a notch 1616 or a notch 1618 configured for receiving the guide projection 706 of the example 1302 of a slider, or the second interior wall 1602 may include both of the notches 1616, 1618. The notch 1516 or 1616 or both of notches 1516 and 1616 cooperating together may form a key-retracted end-position for the path of the slider 1302 in the longitudinal directions indicated by the arrow 306. The notch 1518 or 1618 or both of notches 1518 and 1618 cooperating together may form a key-extended end-position for the path of the slider 1302 in the longitudinal directions indicated by the arrow 306.

Likewise, the first interior wall 1508 may include a notch 1520 or a notch 1522 configured for receiving the guide projection 706 of the example 1304 of a slider, or the first interior wall 1508 may include both of the notches 1520, 1522. The second interior wall 1608 may include a notch 1620 or a notch 1622 configured for receiving the guide projection 706 of the example 1304 of a slider, or the second interior wall 1608 may include both of the notches 1620, 1622. The notch 1520 or 1620 or both of notches 1520 and 1620 cooperating together may form a key-retracted end-position for the path of the slider 1304 in the longitudinal directions indicated by the arrow 306. The notch 1522 or 1622 or both of notches 1522 and 1622 cooperating together may form a key-extended end-position for the path of the slider 1304 in the longitudinal directions indicated by the arrow 306. As further examples, one or more of notches 1524, 1526, 1528, 1530, 1532, 1624, 1626, 1628, 1630, and 1632 may be included in the key organizing device 100, configured for receiving the guide projection 706 of one of the examples 1302, 1304 of sliders, or of other sliders (not shown).

The first housing element may include slots 1534, and the second housing element may include slots 1634, configured for mutual alignment when the first and second housing elements 308, 310 are assembled together to form the housing 102. Aligned pairs of slots 1534, 1634 in the housing 102 may be utilized for holding, as examples, an indicia plate 326 or a decorative plate (not shown). Keyport™ is a trademark of Spuren Systems, LLC.

Figure 17:
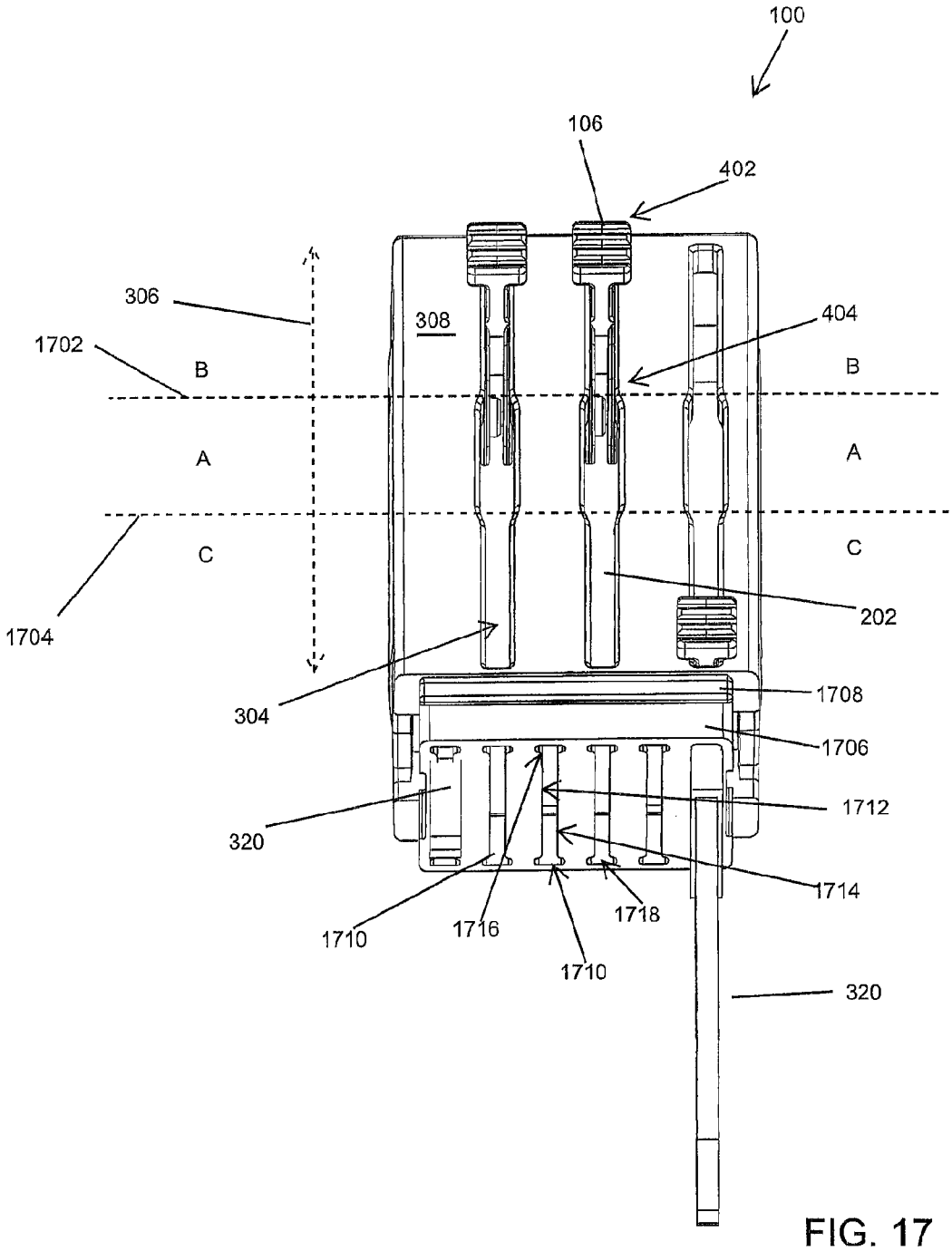
FIG. 17 is another perspective view showing an example of the key organizing device shown in FIG. 1 with the cover and several keys removed.

FIG. 17 is another perspective view showing an example of the key organizing device 100 shown in FIG. 1 with the cover 104 and several keys 320 removed. FIG. 17 illustrates an example 106 of a slider having a finger pad 402 connected through the first housing element 308 to a key mount 404 in the cavity 202.

Figure 18:
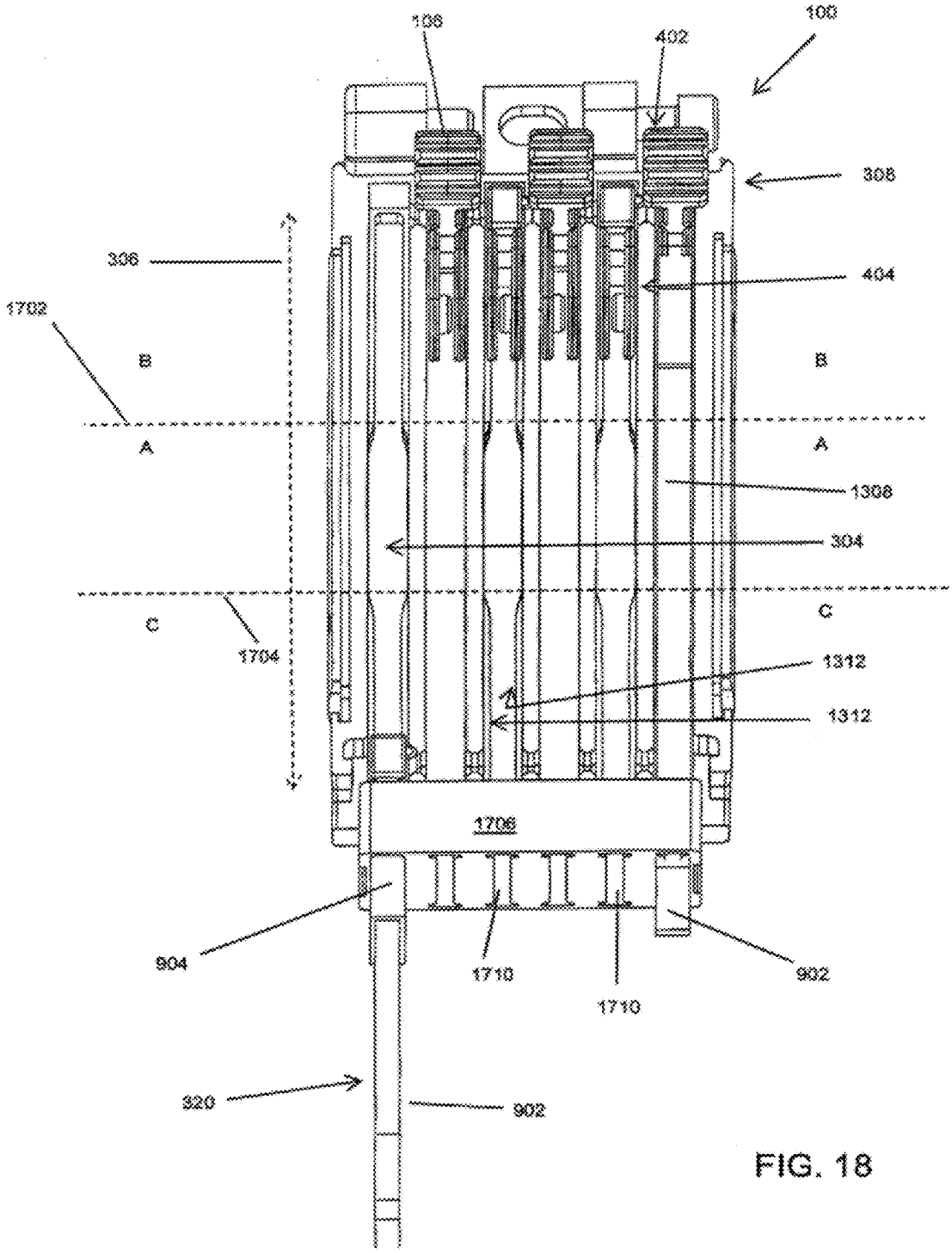
FIG. 18 is an interior view of the example of the key organizing device shown in FIG. 1, with the second housing element removed.

FIG. 18 is an interior view of the example of the key organizing device 100 shown in FIG. 1, with the second housing element 310 removed. A slider opening 304 of the first housing element 308 may be configured as shown in FIGS. 17 and 18 so that a key mount 404 may, without a key 320 attached, pass through the slider opening 304 when the example 106 of a slider is positioned along the longitudinal direction indicated by the arrow 306 at a point in the region A between the dotted lines 1702, 1704. A slider opening 304 of the first housing element 308 may further be configured as shown in FIGS. 17 and 18 so that a key mount 404 may be obstructed by the first housing element 308 from passing through the slider opening 304 when the example 106 of a slider is positioned along the longitudinal direction indicated by the arrow 306 at a point in the region B or C not between the dotted lines 1702, 1704. For example, first glide plates 610, 704 of the example 106 of a slider may contact and be obstructed in the regions B and C from passing through the slider opening 304 by exposed slot edges 1312 of the first interior surface 1308. In further examples (not shown) the slider opening 304 may be configured with the region A located at another position along the longitudinal direction indicated by the arrow 306, not between the dotted lines 1702, 1704. For example, the slider opening 304 may be configured so that the example 106 of a slider may be enabled to pass through the slider opening 304 when the example 106 of a slider is located at a key-retracted or key-extended end-position for the path of the example 106 of a slider. In a further example (not shown) a back wall 302 of the key organizing device 100 may be configured for removeable attachment to the key organizing device 100, so that an example 106 of a slider may be removed from or inserted into the cavity 202 after removal of the back wall 302.

The example of the key organizing device 100 shown in FIGS. 17 and 18 may include a key dampener 1706 at the end opening 208 shown in FIG. 2. For example, the key dampener 1706 may be fitted between two guide ridges 1708 parallel with the first and second housing base walls 1306, 1406 at the end opening 208. The key dampener 1706 may include a key slot 1710 configured for sliding engagement of a key blade 902. The key slot 1710 may also be configured for sliding engagement of a key head 904. The key slot 1710 may further have two spaced apart slot surfaces 1712, 1714 configured for sliding engagement of a key blade 902, the key slot 1710 also including two flexible slot ends 1716, 1718.

Figure 19:
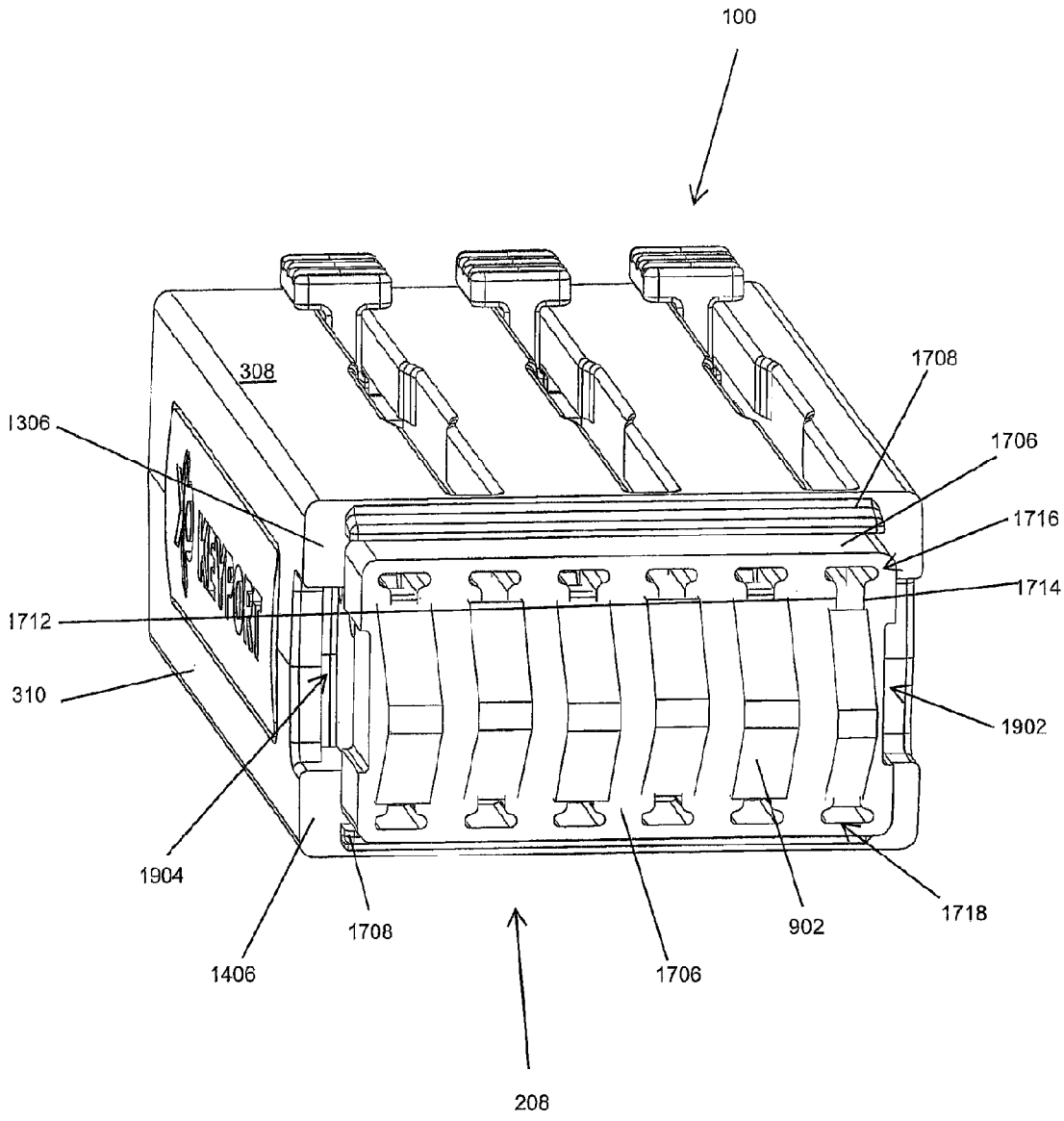
FIG. 19 is a perspective view of another example of the key organizing device shown in FIG. 1, with the cover removed.

FIG. 19 is a perspective view of another example of the key organizing device 100 shown in FIG. 1, with the cover 104 removed. FIG. 19 illustrates the key dampener 1706 fitted between the two guide ridges 1708 parallel with the first and second housing base walls 1306, 1406 at the end opening 208, with key blades 902 in sliding engagement with slot surfaces 1712, 1714 of key slots 1710 also including two flexible slot ends 1716, 1718.

Figure 20:
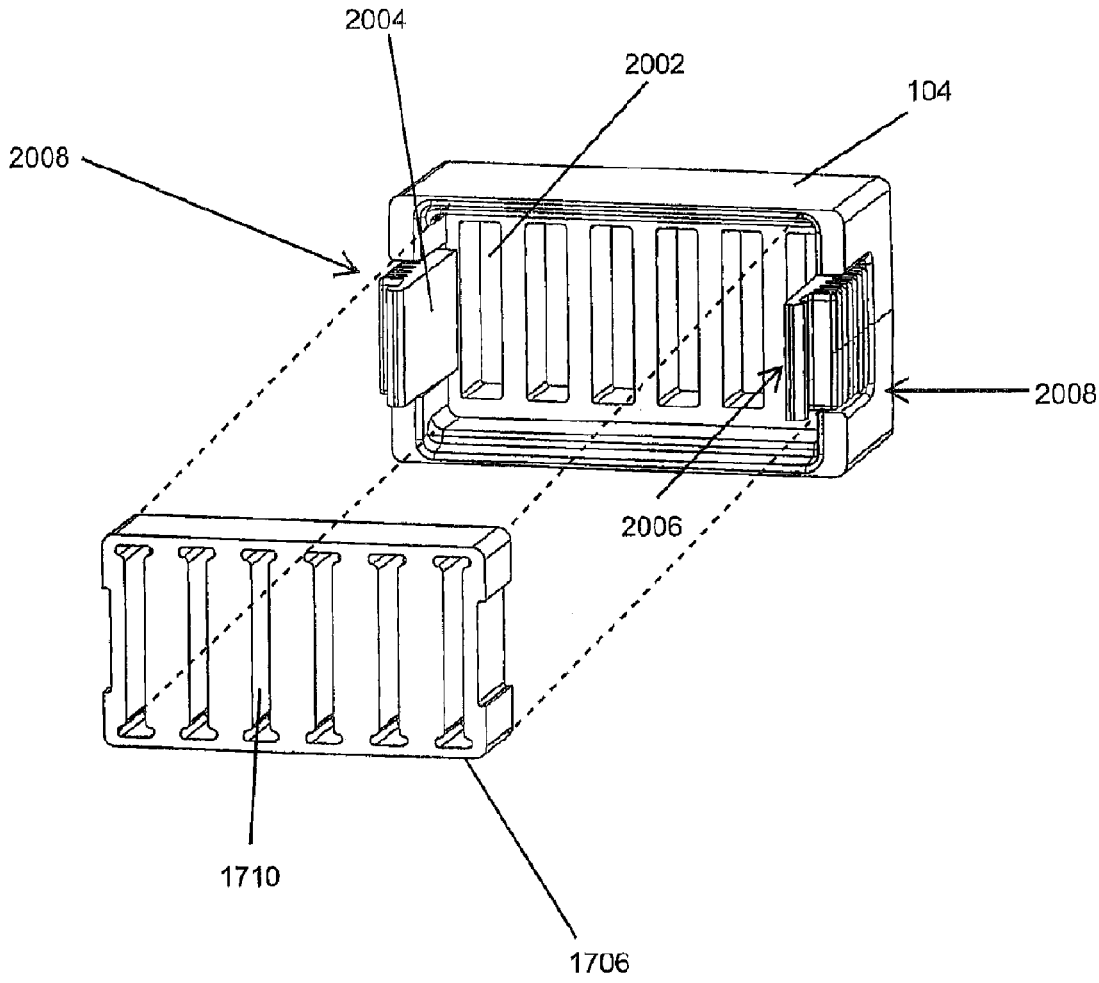
FIG. 20 is an exploded perspective view showing an example of a cover and a key dampener.

FIG. 20 is an exploded perspective view showing an example of the cover 104 and the key dampener 1706. The key dampener 1706 may be sized to fit inside the cover 104 as indicated by the dotted lines so that the cover 104 holding the key dampener 1706 may be attached to and removed from the end opening 208 formed by the first housing element 308 and the second housing element 310. The cover 104 includes key slots 2002 in mutual alignment with the key slots 1710 in the key dampener 1706 and with keys 320 in the key organizing device 100 as shown in FIG. 1. The cover 104 and key dampener 1706 may be attached over keys 320 and the end opening 208 in the directions of the arrows 408 and removed from the end opening 208 in the directions of the arrows 406 as earlier discussed in connection with FIG. 4. The cover 104 may have two tabs 2004, 2006 spaced-apart and together forming a bezel configured for engaging the housing 102 for removable attachment of the cover 104 over the end opening 208. For example, the tabs 2004, 2006 may be configured for insertion into slots 1902, 1904 respectively as also shown in FIGS. 13-14, set into the first and second housing elements 308, 310 at the end opening 208. Referring to FIGS. 4, 13 and 14, the tabs 2004, 2006 may include hooks 410 for engaging hooks 1324, 1424 on the slots 1902, 1904. The tabs 2004, 2006 may have friction plates 2008 for gripping the cover 104. The hooks 410 may be disengaged from the hooks 1324, 1424 on the slots 1902, 1904, by squeezing the tabs 2004, 2006 together.

Figure 21:
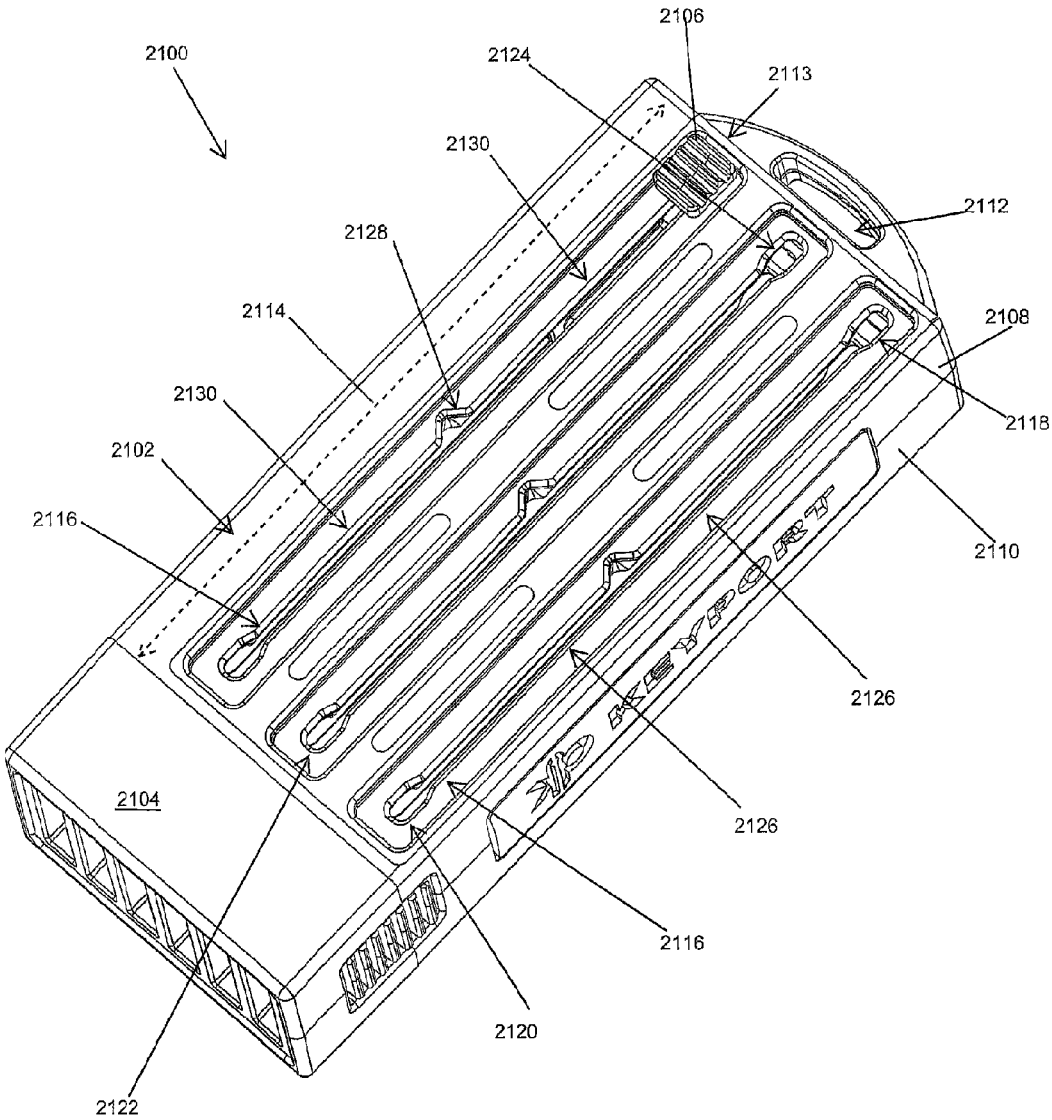
FIG. 21 is a top view showing another example of a key organizing device, incorporating certain features of the key organizing device shown in FIG. 1.

FIG. 21 is a top view showing another example of a key organizing device 2100, incorporating features of the key organizing device 100 shown in FIG. 1 and discussed above, except as now explained. The above discussion of the key organizing device 100 and the accompanying FIGS. 1-20 accordingly are incorporated in their entireties into this discussion of the key organizing device 2100. The key organizing device 2100 includes a housing 2102, a cover 2104, and a finger pad 2106. The housing 2102 includes a first housing element 2108, and a second housing element 2110.

Figure 22:
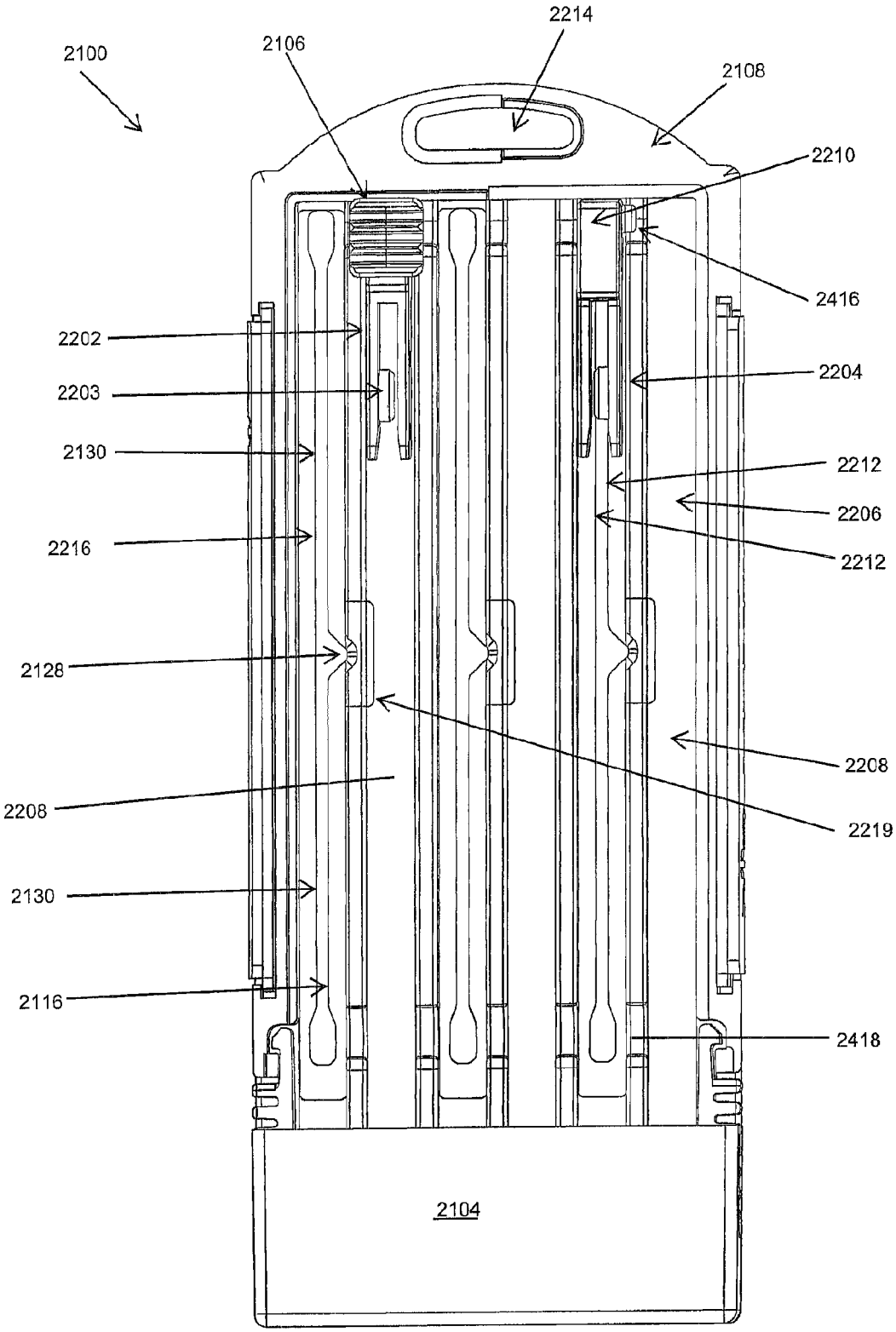
FIG. 22 is an interior view of the key organizing device shown in FIG. 21, from which a second housing element has been removed.

FIG. 22 is an interior view of the key organizing device 2100 shown in FIG. 21, from which the second housing element 2110 has been removed. The first housing element 2108 includes two sliders 2202, 2204. Keys 320 (not shown) may be attached to the sliders 2202, 2204 in the same manner as earlier discussed in connection with the key organizing device 100.

Figure 23:
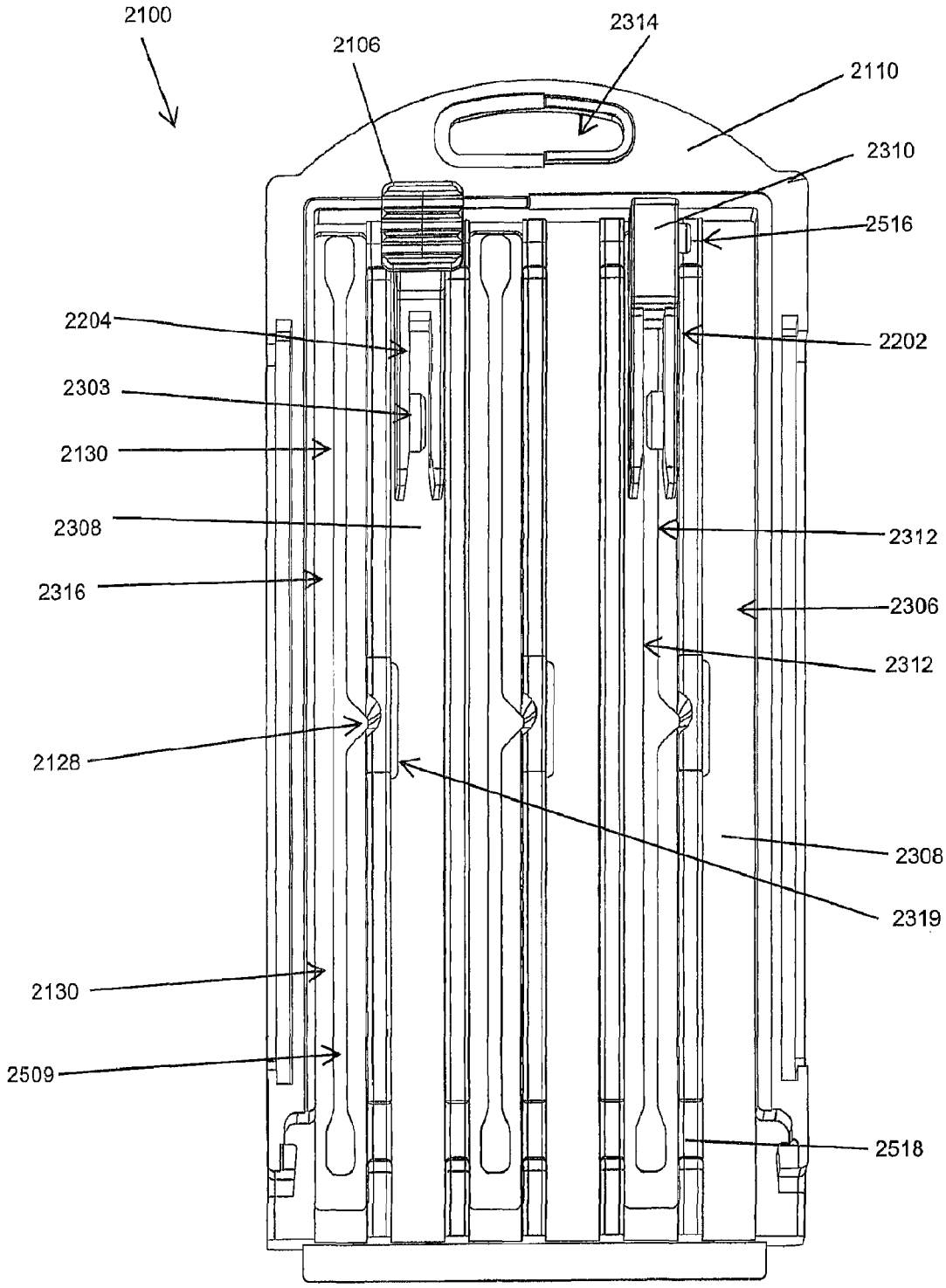
FIG. 23 is an interior view of the key organizing device shown in FIG. 21, from which a first housing element has been removed.

FIG. 23 is an interior view of the key organizing device 2100 shown in FIG. 21, from which the first housing element 2108 has been removed. The first housing element 2108 of the housing 2102 includes a first housing base wall 2206 having a first interior surface 2208 in the cavity (not shown) formed by the first and second housing elements 2108, 2110. The second housing element 2110 includes a second housing base wall 2306 having a second interior surface 2308 in the cavity (not shown). The first and second interior surfaces 2208, 2308 face each other in the cavity (not shown) in the same manner as discussed earlier in connection with the first and second housing elements 308, 310 of the key organizing device 100.

Referring to FIGS. 6, 7, 22 and 23, the sliders 2202, 2204 may respectively include first glide plates 2403, 2503 and second glide plates 2505, 2405. The first glide plates 2203, 2205 of the slider 2202 may contact exposed slot edges 2312 of the second interior surface 2308. The first glide plates 610, 704 of the slider 2204 may contact exposed slot edges 2212 of the first interior surface 2208. The second glide plate 2310 of the slider 2202 may contact the first interior surface 2208. The second glide plate 2210 of the slider 2204 may contact the second interior surface 2308. The sliders 2202, 2204 may accordingly be configured for gliding on the first glide plates 2203, 2205 and second glide plates 2210, 2310 over the first and second interior surfaces 2208, 2308.

The first and second housing elements 2108, 2110 may respectively include apertures 2214, 2314, together forming a slot 2112. In another example (not shown) the apertures 2214, 2314 may be integrated into a depression formed in a back wall 2113 of the key organizing device 2100.

Figure 24:
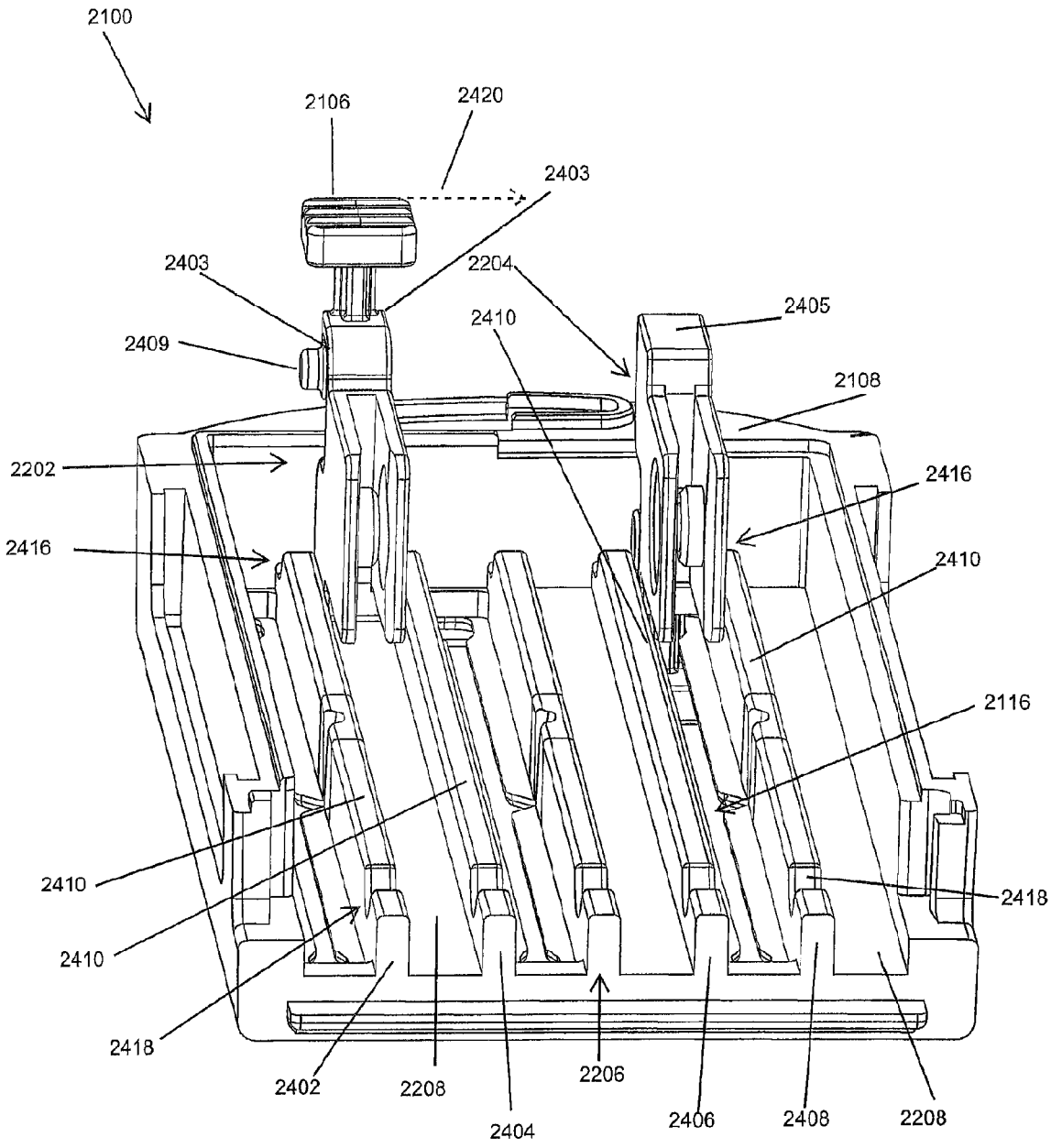
FIG. 24 is another interior view of the key organizing device shown in FIG. 21, from which a second housing element has been removed.
Figure 25:
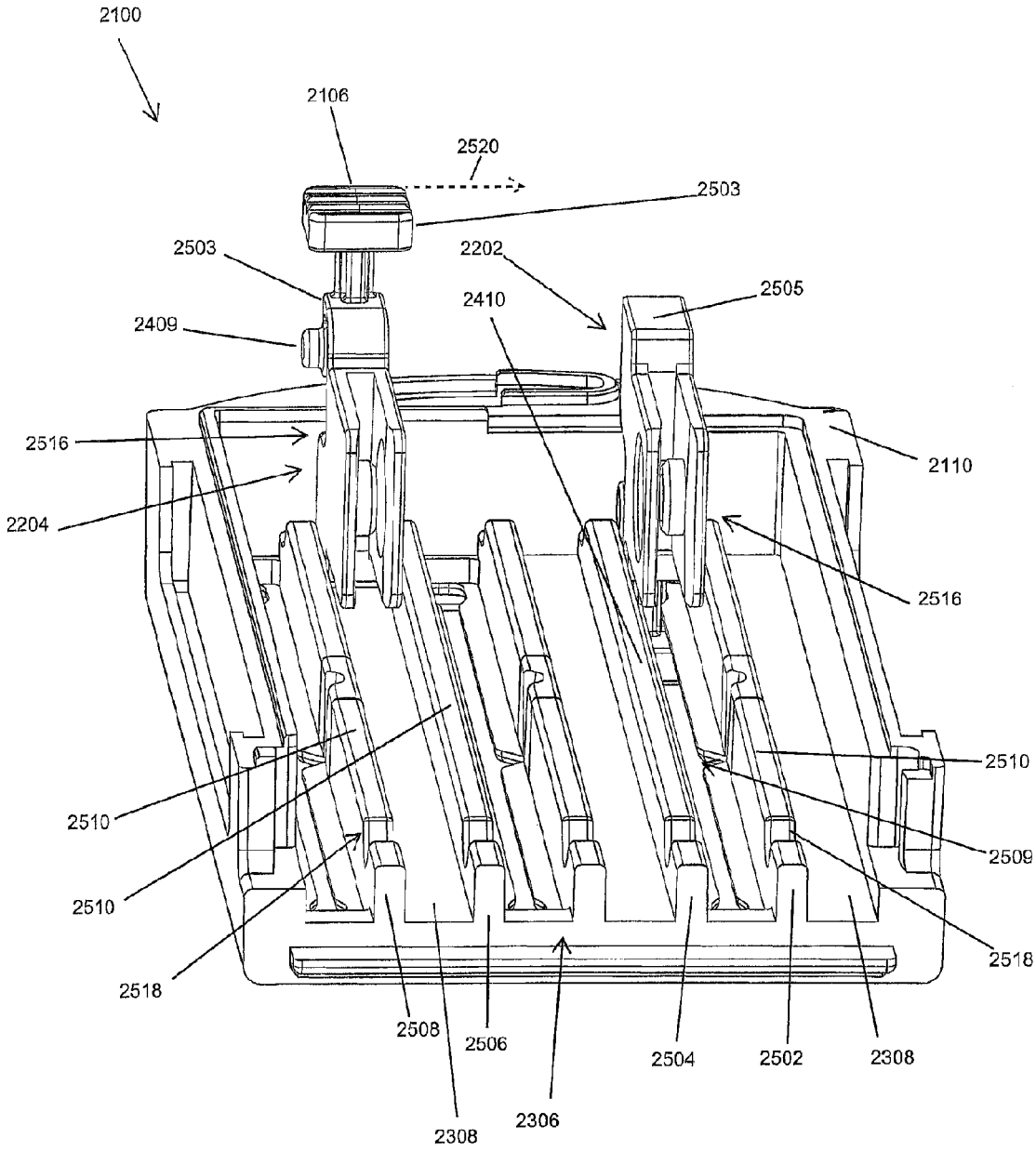
FIG. 25 is another interior view of the key organizing device shown in FIG. 21, from which a first housing element has been removed.

FIG. 24 is another interior view of the key organizing device 2100 shown in FIG. 21, from which the second housing element 2110 has been removed. Similarly, FIG. 25 is another interior view of the key organizing device 2100 shown in FIG. 21, from which the first housing element 2108 has been removed. The first interior surface 2208 of the first housing base wall 2206 may, for example, have two first interior walls 2402, 2404 spaced apart on the first interior surface 2208 and projecting toward the second interior surface 2308 of the second housing base wall 2306, the first interior walls 2402, 2404 guiding the slider 2202 along a path in the longitudinal direction of an arrow 2114 in alignment with a slider opening 2509 in the second housing element 2110. The second interior surface 2308 of the second housing base wall 2306 may, for example, have two second interior walls 2502, 2504 spaced apart on the second interior surface 2308 and projecting toward the first interior surface 2208 of the first housing base wall 2206, the second interior walls 2502, 2504 guiding the slider 2202 along a path in the longitudinal direction of the arrow 2114 in alignment with the slider opening 2509.

In a similar manner, the first interior surface 2208 of the first housing base wall 2206 may, for example, have two first interior walls 2406, 2408 spaced apart on the first interior surface 2208 and projecting toward the second interior surface 2308 of the second housing base wall 2306, the first interior walls 2406, 2408 guiding the slider 2204 along a path in the longitudinal direction of the arrow 2114 in alignment with a slider opening 2509. The second interior surface 2308 of the second housing base wall 2306 may in a similar manner, for example, have two second interior walls 2506, 2508 spaced apart on the second interior surface 2308 and projecting toward the first interior surface 2208 of the first housing base wall 2206, the second interior walls 2506, 2508 guiding the slider 2204 along a path in the longitudinal direction of the arrow 2114 in alignment with a slider opening 2116.

Each of the first interior walls 2402, 2404, 2406, 2408 may include a first interior wall edge 2410 facing one of the second interior walls 2502, 2504, 2506, 2508, and each of the second interior walls 2502, 2504, 2506, 2508 may include a second interior wall edge 2510 spaced apart by a gap (not shown) from and facing one of the first interior walls 2402, 2404, 2406, 2408.

Referring to FIGS. 7, 24 and 25, each of the sliders 2202, 2204 may include a guide projection 2409 configured to glide along a first interior wall edge 2410 or along a second interior wall edge 2510, or along both of the interior wall edges 2410, 2510.

The second interior wall 2502 may include a notch 2516 or a notch 2518 configured for receiving the guide projection 2409 of the slider 2202, or the first interior wall 2502 may include both of the notches 2516, 2518. The first interior wall 2408 may include a notch 2416 or a notch 2418 configured for receiving the guide projection 2409 of the slider 2204, or the first interior wall 2408 may include both of the notches 2416, 2418. The notch 2516 may form a key-retracted end-position for the path of the slider 2202 in the longitudinal directions indicated by the arrow 2114. The notch 2518 may likewise form a key-extended end-position for the path of the slider 2202 in the longitudinal directions indicated by the arrow 2114.

Referring to FIGS. 21-25, the slider openings 2116, 2509 may define a key-retracted end-position 2118 and a key-extended end-position 2120 for the path of a slider 2202, 2204. The notches 2416, 2418, 2516, 2518 may be located at notch points along the first or second interior wall edges 2408, 2502 for reversibly locking the sliders 2202, 2204 in an end-position 2118, 2120. The finger pad 2106 of a slider 2202, 2204 may be configured for pushing the guide projection 2409 out of the notch 2416, 2418, 2516, 2518 upon deflection of the finger pad 2106 in the direction of one of the arrows 2420, 2520. The slider openings 2116, 2509 may include at least two wide regions 2122, 2124 spaced apart along the longitudinal direction indicated by the arrow 2114, respectively allowing a guide projection 2409 to enter a notch 2416, 2516 at the key-retracted end position 2118 and to enter a notch 2418, 2518 at the key-extended end-position 2120. The slider openings 2116, 2509 may also include at least one narrow region 2126 between the two wide regions 2122, 2124 along the longitudinal direction indicated by the arrow 2114, constraining the guide projection 2409 in the direction of the arrows 2420, 2520 away from the interior walls 2402, 2404, 2406, 2408, 2502, 2504, 2506, 2508.

The slider openings 2116, 2509 may include a slider dampener 2216, 2316 on the exposed slot edge 2212, 2312. For example, the slider dampener 2216, 2316 may include a resilient layer (not shown) on the exposed slot edge 2212, 2312. As another example (not shown), all or a part of the exposed slot edge 2212, 2312 may be formed of a resilient material attached to the first or second housing element 2108, 2110 to form the slider dampener 2216, 2316. The slider dampener 2216, 2316 may be configured for gripping the slider 2202, 2204. The slider openings 2116, 2509 may be configured at a first point 2128 along the longitudinal direction indicated by the arrow 2114 so that a key mount 2203, 2303 can pass through the slider openings 2116, 2509 at the first point 2128. The slider openings 2116, 2509 may be configured at a second point 2130 along the longitudinal direction indicated by the arrow 2114 so that the slider dampener 2216, 2316 grips the slider 2202, 2204 at the second point 2130. As another example, the first or second housing element 2108, 2110 may include a rectangular cutout 2219, 2319 filled by the slider dampener 2216, 2316. This cutout 2219, 2319 provides extra clearance through the slider opening 2116, 2509 for passage of the key mount 2203, 2303 by deflection of the slider dampener 2216, 2316.

Figure 26:
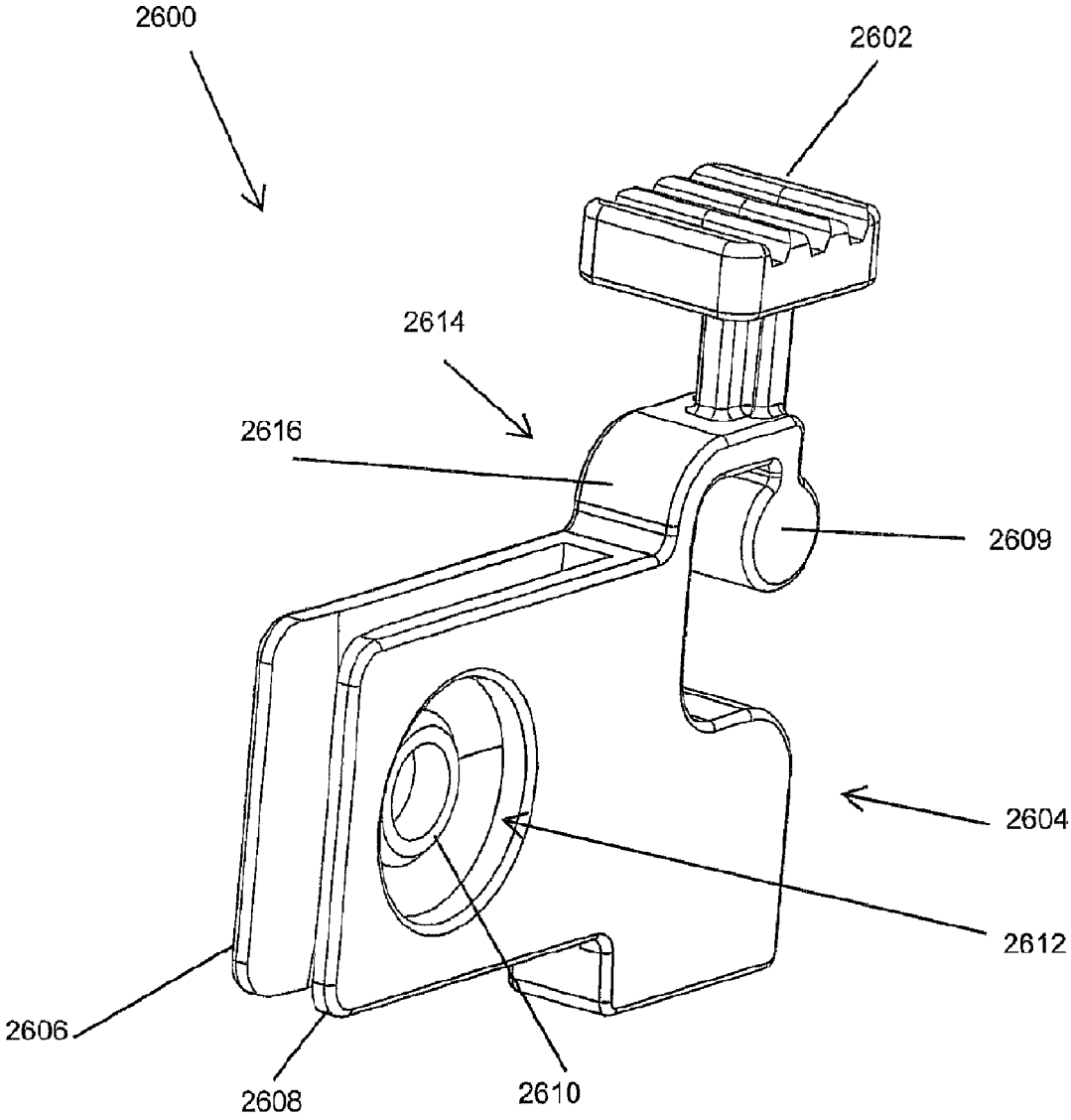
FIG. 26 is a perspective view showing an example of a slider that may be utilized in the key organizing device shown in FIG. 21.

FIG. 26 is a perspective view showing an example 2600 of a slider that may be utilized in the key organizing device 2100 shown in FIG. 21. The slider 2600 includes a finger pad 2602 and a key mount 2604. The key mount 2604 includes spaced-apart first and second key mounting plates 2606, 2608. The first key mounting plate 2606 has a mounting post 2610. The second key mounting plate 2608 may include a plate opening 2612 in spaced-apart alignment with the mounting post 2610. The example 2600 of a slider further includes a guide projection 2609.

Figure 27:
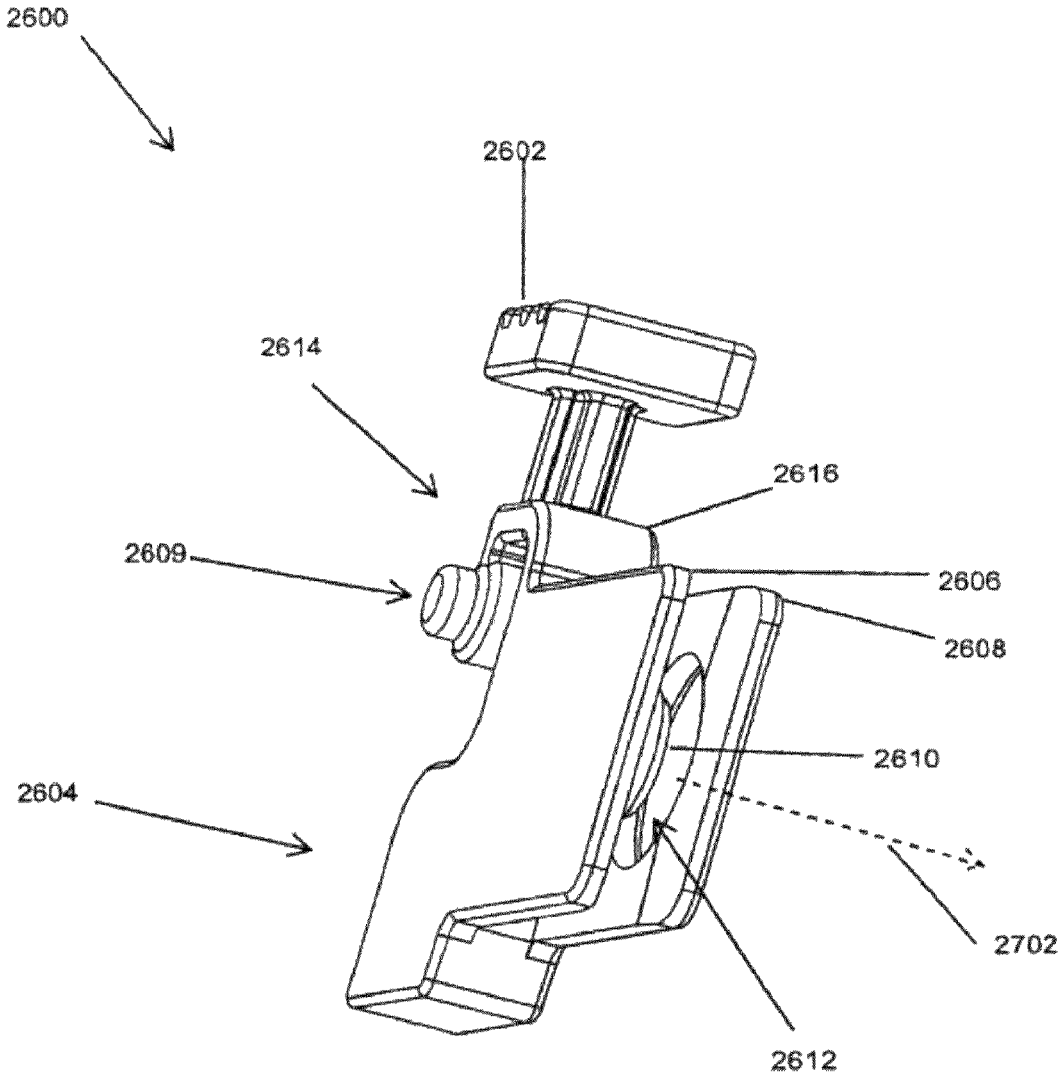
FIG. 27 is another perspective view of the example of a slider shown in FIG. 26.

FIG. 27 is another perspective view of the example 2600 of a slider shown in FIG. 26. FIGS. 26 and 27 illustrate that the mounting post 2610 projects in the direction of the arrow 2702 toward the second key mounting plate 2608.

The example 2600 of a slider may include a tensioning member 2614 configured to press the guide projection 2609 against the first interior wall edge 2410 or against the second interior wall edge 2510. The tensioning member 2614 may be interposed between the key mount 2604 and the finger pad 2602. The tensioning member 2614 may be configured for compression between the finger pad 2602 and the key mount 2604 upon depression of the finger pad 2602 toward the housing 2102. The tensioning member 2614 may include a spring element 2616. The finger pad 2602 may be configured for pushing the guide projection 2609 out of a notch 2416, 2418, 2516, 2518 upon depression of the finger pad 2602 toward the housing 2102.

Figure 28:
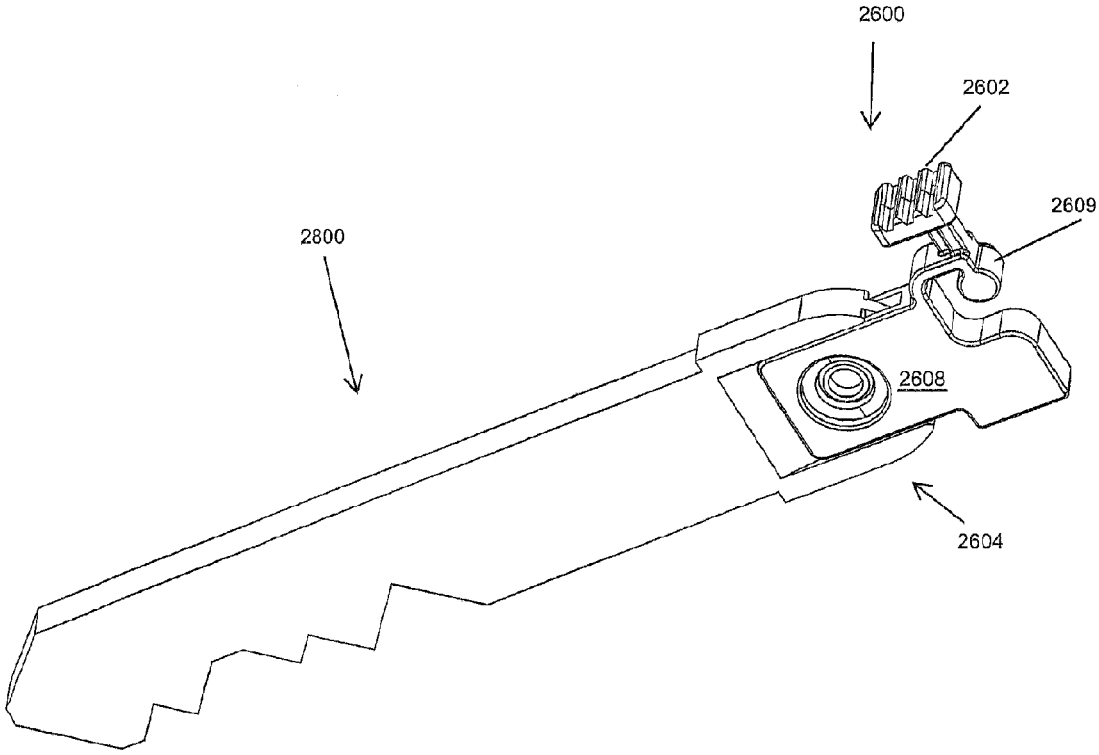
FIG. 28 is a perspective view showing an example of an implementation of a key that may be utilized as the keys shown in FIG. 1, and of the slider shown in FIG. 26.

FIG. 28 is a perspective view showing an example of an implementation of a key 2800. As illustrated, the key 2800 may be utilized as the keys 320 shown in FIG. 1 and discussed earlier, removeably attached to the key mount 2604 of the example 2600 of a slider shown in FIG. 26.

Figure 29:
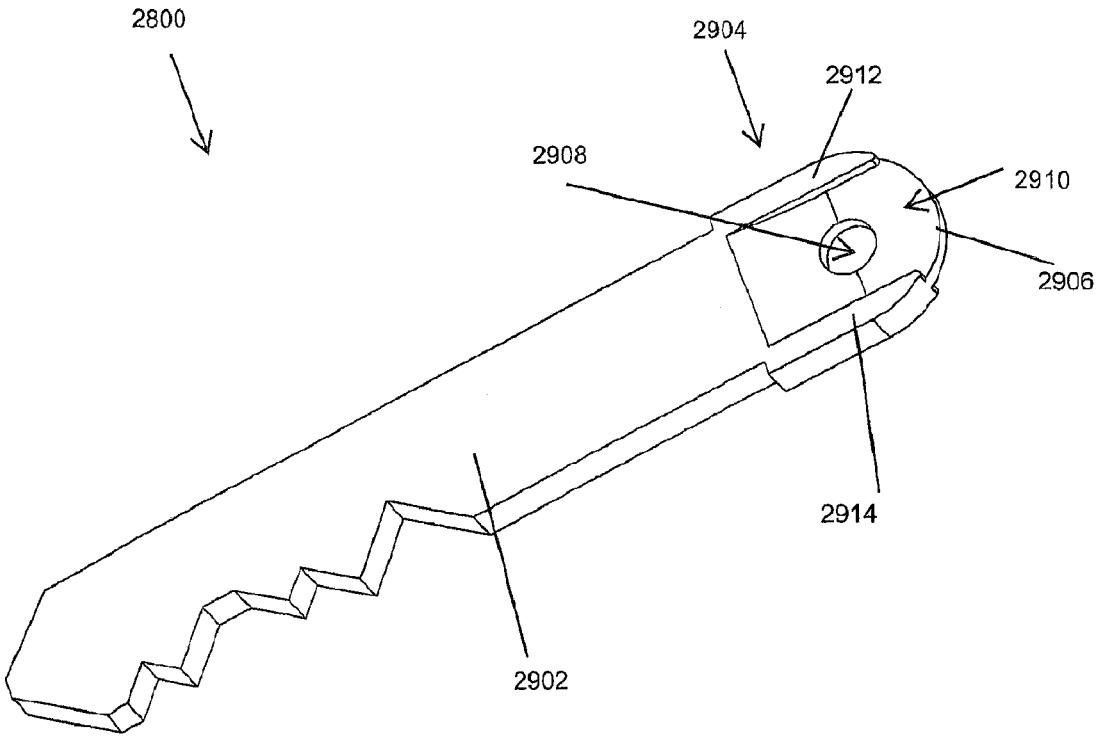
FIG. 29 is another perspective view of the key shown in FIG. 28.

FIG. 29 is another perspective view of the key 2800 shown in FIG. 28. This key 2800 is detached from the example 2600 of a slider.

Figure 30:
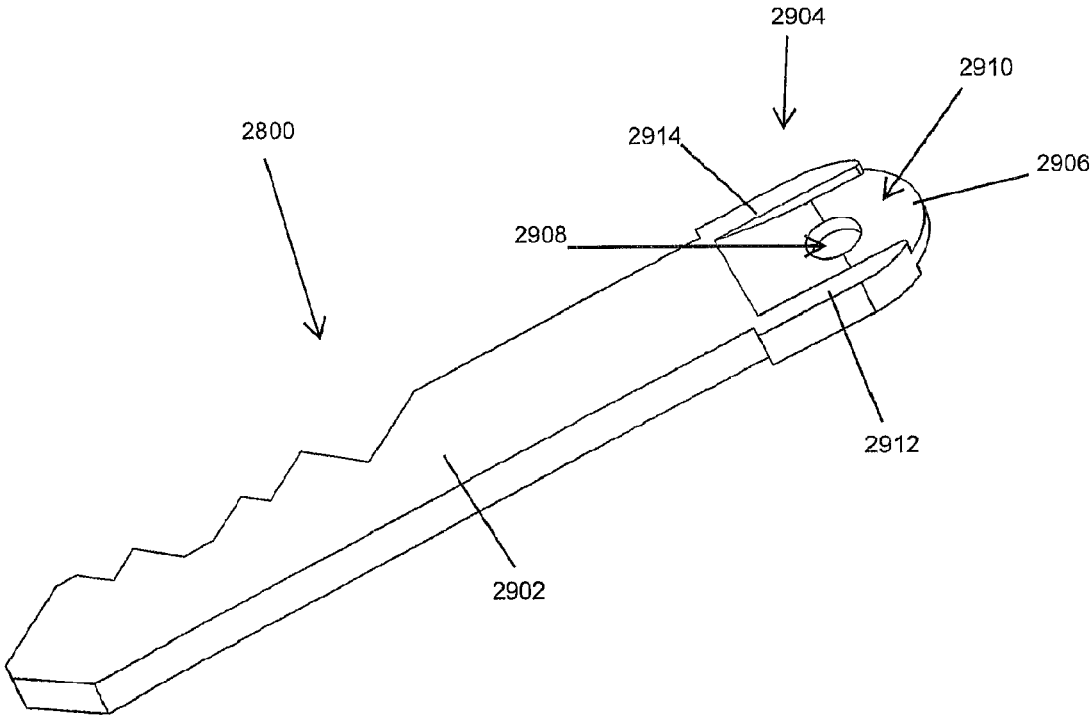
FIG. 30 is an additional perspective view of the key shown in FIG. 28.

FIG. 30 is an additional perspective view of the key 2800 shown in FIG. 28, detached from the example 2600 of a slider.

The key 2800 includes a key blade 2902, and a key head 2904 connected to the key blade 2902. The key head 2904 has an edge 2906, and a head aperture 2908 in the key head 2904. The head aperture 2908 is spaced apart from the edge 2906. The key head 2904 includes a ramp 2910 and two guide ridges 2912, 2914. The ramp 2910 is between the two guide ridges 2912, 2914. The key mount 2604 may be configured for guiding the mounting post 2610 into and out of the head aperture 2908, and for guiding the key head 2904 into and out of the key mount 2604. The key mounting plates 2606, 2608 may be configured for sliding over the ramp 2910 between the two guide ridges 2912, 2914.

Figure 31:
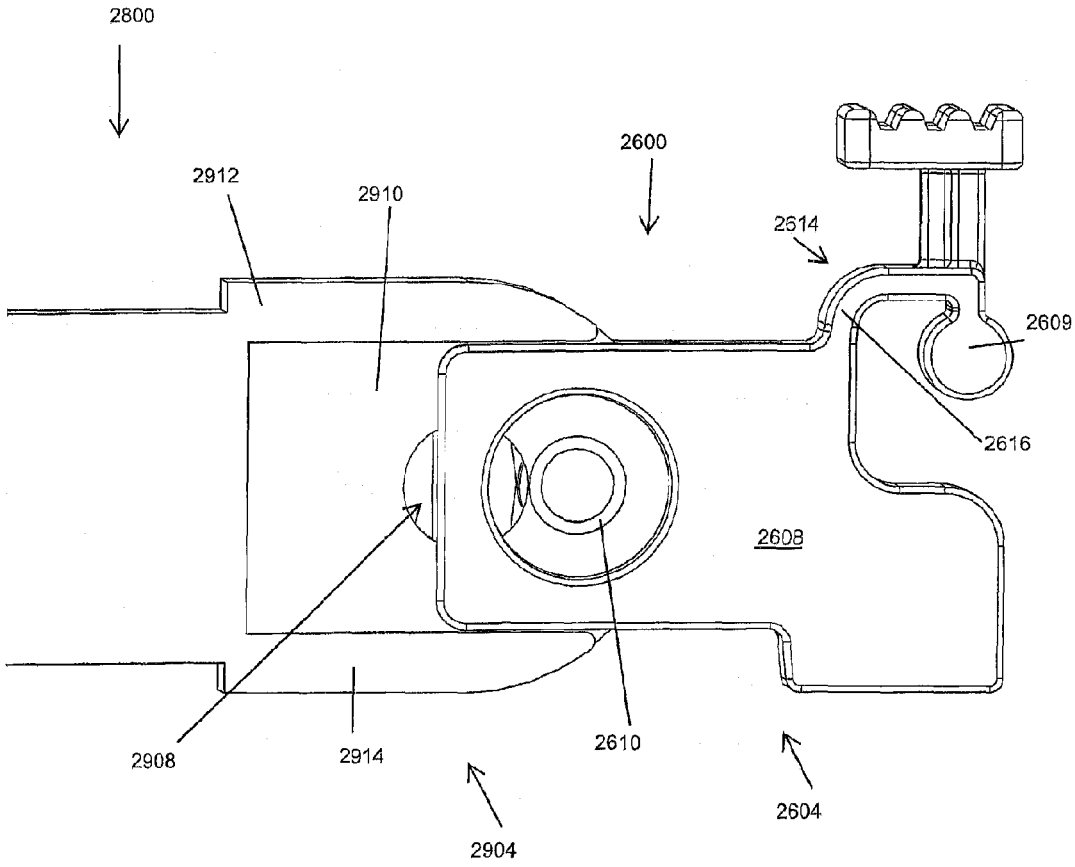
FIG. 31 is side view showing part of the key shown in FIGS. 28-30, and the slider shown in FIG. 26.

FIG. 31 is side view showing part of the key 2800 of FIGS. 28-30, partially attached to the example 2600 of a slider shown in FIG. 26. In this example, the key mounting plates 2606, 2608 configured for sliding over the ramp 2910 between the two guide ridges 2912, 2914 guide the mounting post 2610 into and out of the head aperture 2908 and in guiding the key head 2904 into and out of the key mount 2604.

Figure 32:
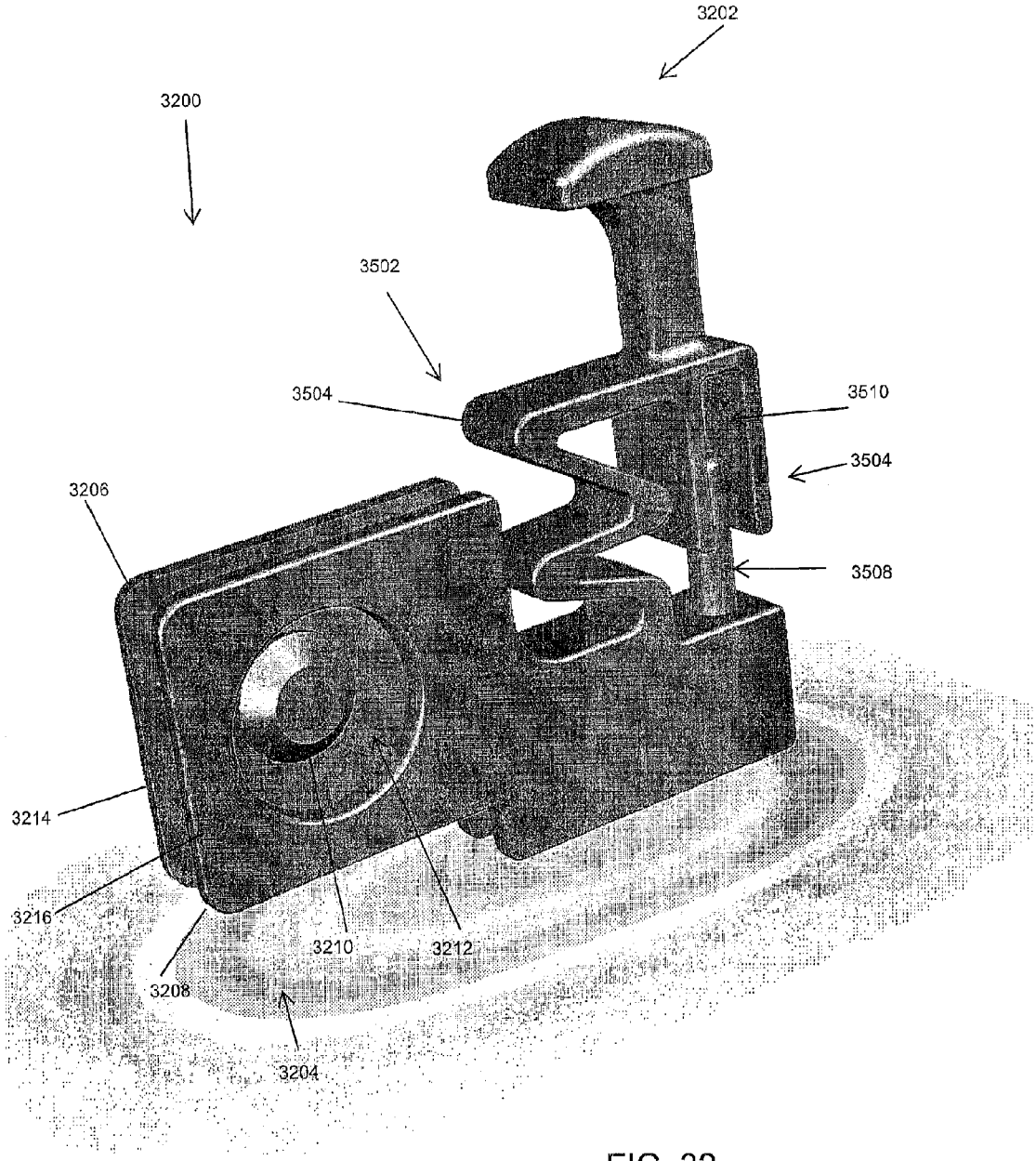
FIG. 32 is a perspective view showing an example of a slider that may be utilized together with the key shown in FIG. 28.

FIG. 32 is a perspective view showing an example of a slider 3200 that may be utilized together with the key 2800 in the example of a key organizing device 2100 modified as explained below. The example of a slider 3200 includes a finger pad 3202 and a key mount 3204. The key mount 3204 includes spaced-apart first and second key mounting plates 3206, 3208. The first key mounting plate 3206 has a mounting post 3210. The second key mounting plate 3208 may include a plate opening 3212 in spaced-apart alignment with the mounting post 3210.

Figure 33:
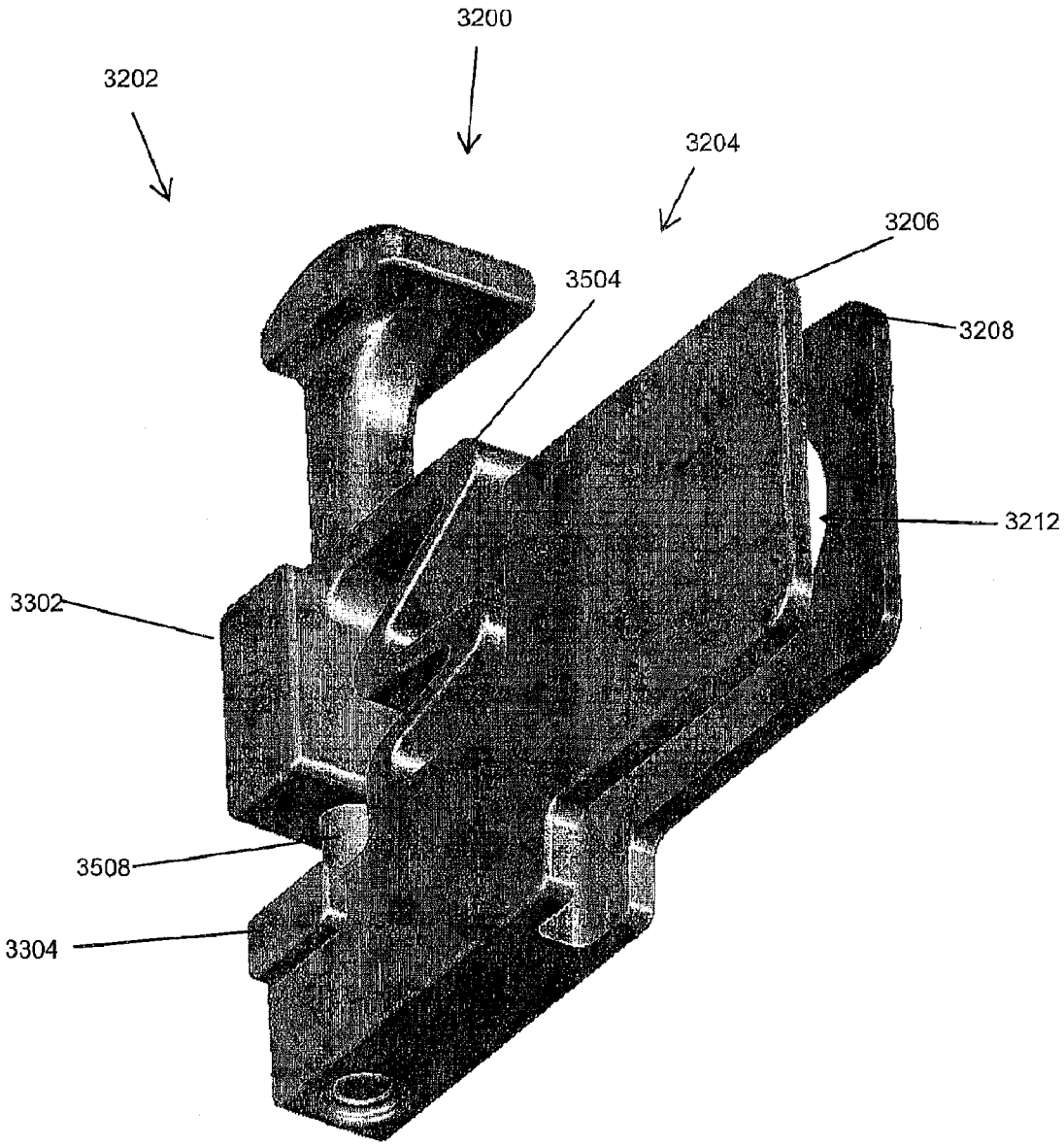
FIG. 33 is another perspective view of the example of a slider shown in FIG. 32.

FIG. 33 is another perspective view of the example 3200 of a slider shown in FIG. 32. The example 3200 of a slider further includes an upper guide projection 3302 and a lower guide projection 3304.

Figure 34:
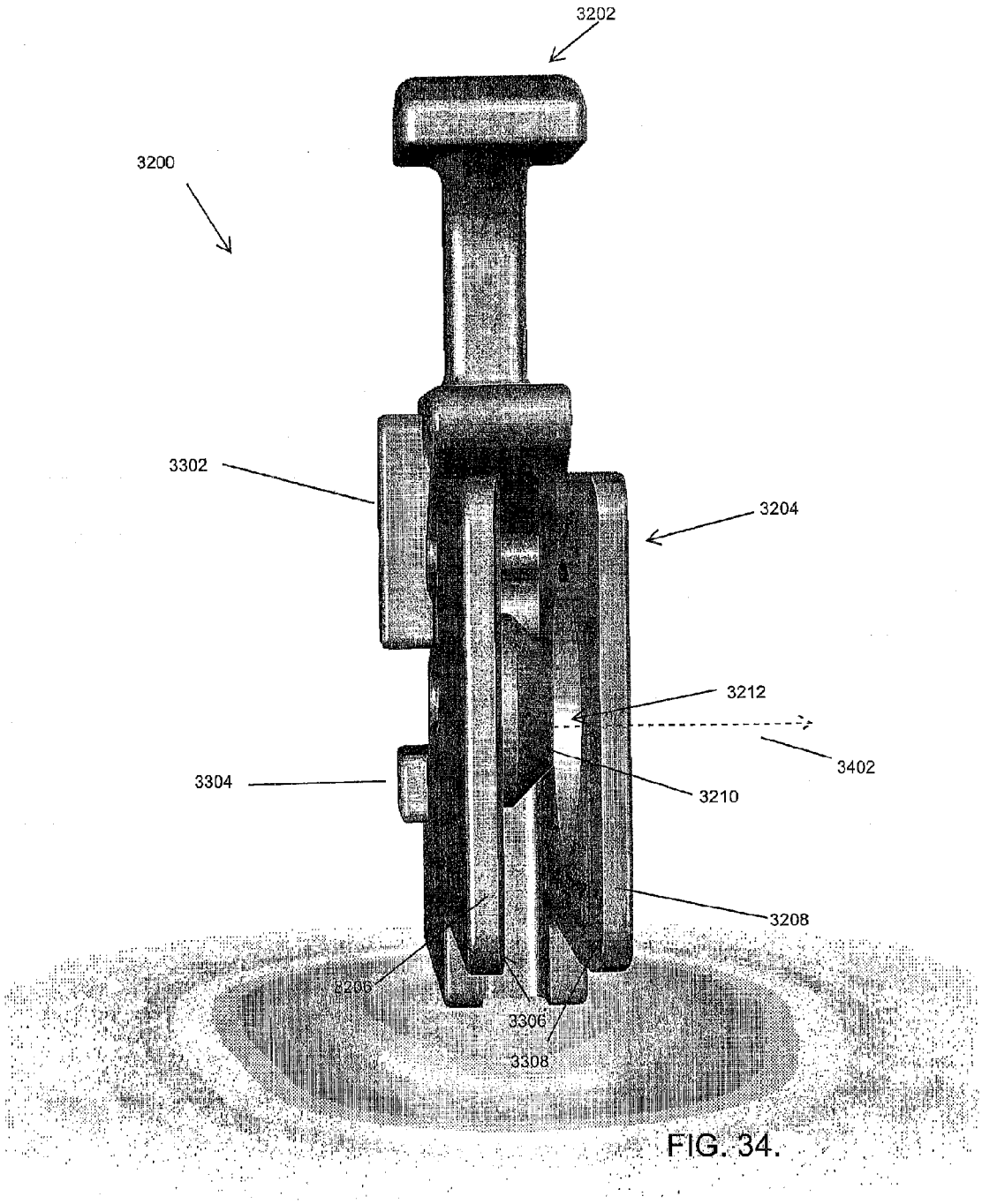
FIG. 34 is an additional perspective view of the example of a slider shown in FIG. 32.

FIG. 34 is an additional perspective view of the example 3200 of a slider shown in FIG. 32. FIGS. 32-34 illustrate that the mounting post 3210 projects in the direction of the arrow 3402 toward the second key mounting plate 3208.

Figure 35:
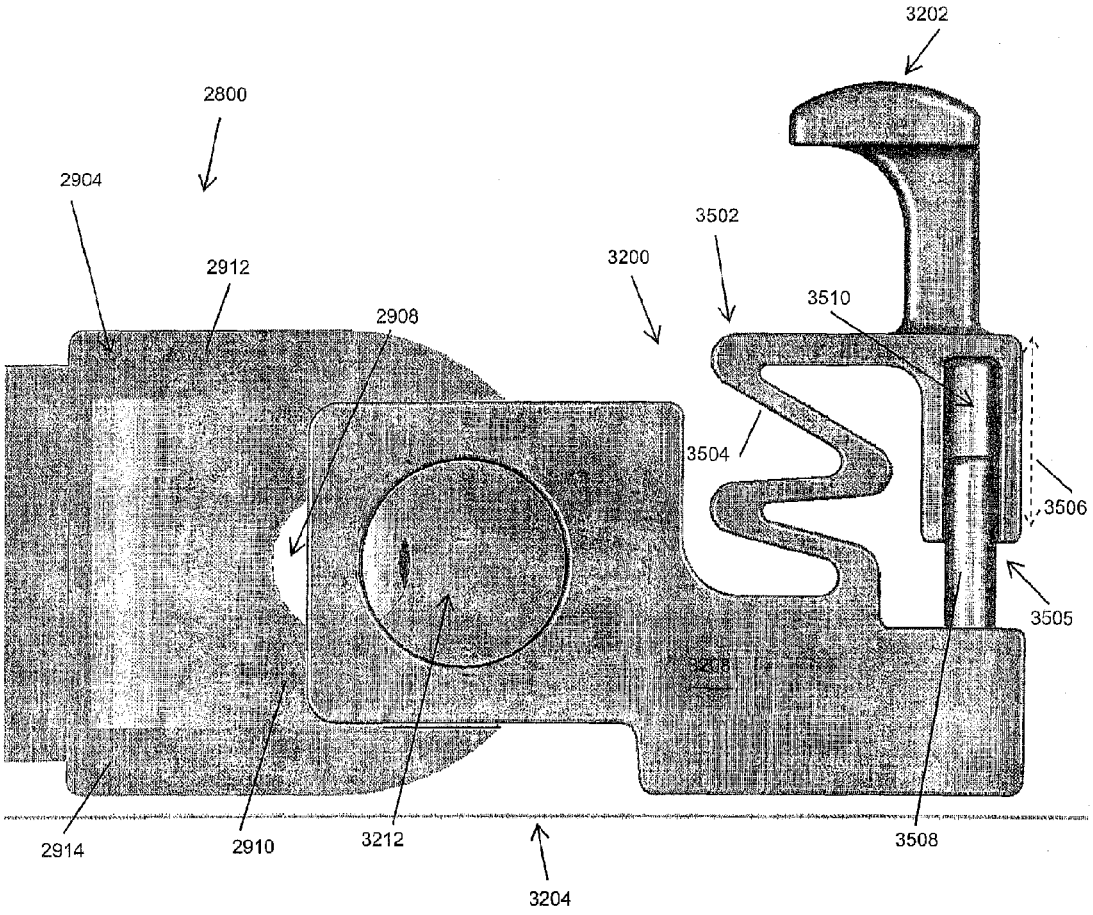
FIG. 35 is side view showing part of the key shown in FIGS. 29-30, and the slider shown in FIG. 32.

FIG. 35 is side view showing part of the key 2800 of FIGS. 29-30, partially attached to the example 3200 of a slider shown in FIG. 32. The key mount 3204 may be configured for guiding the mounting post 3210 into and out of the head aperture 2908, and for guiding the key head 2904 into and out of the key mount 3204. The key mounting plates 3206, 3208 may be configured for sliding over the ramp 2910 between the two guide ridges 2912, 2914. In this example, the key mounting plates 3206, 3208 configured for sliding over the ramp 2910 between the two guide ridges 2912, 2914 guide the mounting post 3210 into and out of the head aperture 2908 and in guiding the key head 2904 into and out of the key mount 3204.

Referring to FIGS. 24, 25, and 32-34, the upper guide projection 3302 or the lower guide projection 3304 or both of the guide projections 3302, 3304 in the example 3200 of a slider may be configured to glide along either a first interior wall edge 2410 or along a second interior wall edge 2510, or along both of the interior wall edges 2410, 2510. The notch 2416 or the notch 2418 or both of the notches 2416, 2418 in the first interior wall 2402 may be configured for receiving the lower guide projection 3304 of the example 3200 of a slider. The notch 2516 or the notch 2518 or both of the notches 2516, 2518 in the second interior wall 2502 may be configured for receiving the upper guide projection 3302 of the example 3200 of a slider. For example, the notches 2416, 2418, 2516, 2518 may have a square shape configured for receiving the guide projections 3302, 3304, similar to the notches 1516-1532, 1618-1632 discussed earlier in connection with the key organizing device 100 and shown in FIGS. 4, 15 and 16.

The example 3200 of a slider may include a tensioning member 3502 configured to press the lower guide projection 3304 against a first or second interior wall edge 2410, 2510 or against both of the wall edges 2410, 2510. The tensioning member 3502 may be interposed between the key mount 3204 and the finger pad 3202. The tensioning member 3502 may be configured for compression between the finger pad 3202 and the key mount 3204 upon depression of the finger pad 3202 toward the housing 2102. The tensioning member 3502 may include a spring element 3504. The finger pad 3202 may be configured for pushing the upper or lower guide projections 3302, 3304 out of a notch 2416, 2418, 2516, 2518 upon depression of the finger pad 3202 toward the housing 2102. The example 2800 of a slider may include a finger pad guiding member 3505 configured for guiding the finger pad 3202 in a fixed path in the directions indicated by the arrow 3506 upon depression of the finger pad 3202 toward the housing 2102. The example 2800 of a slider may include a pin 3508 protruding from the key mount 3204, the pin 3508 defining the fixed path in the directions indicated by the arrow 3506. The pin 3508 may engage a slot 3510 connected to the finger pad 3202, the slot 3510 configured for partially receiving the pin 3508.

Figure 36:
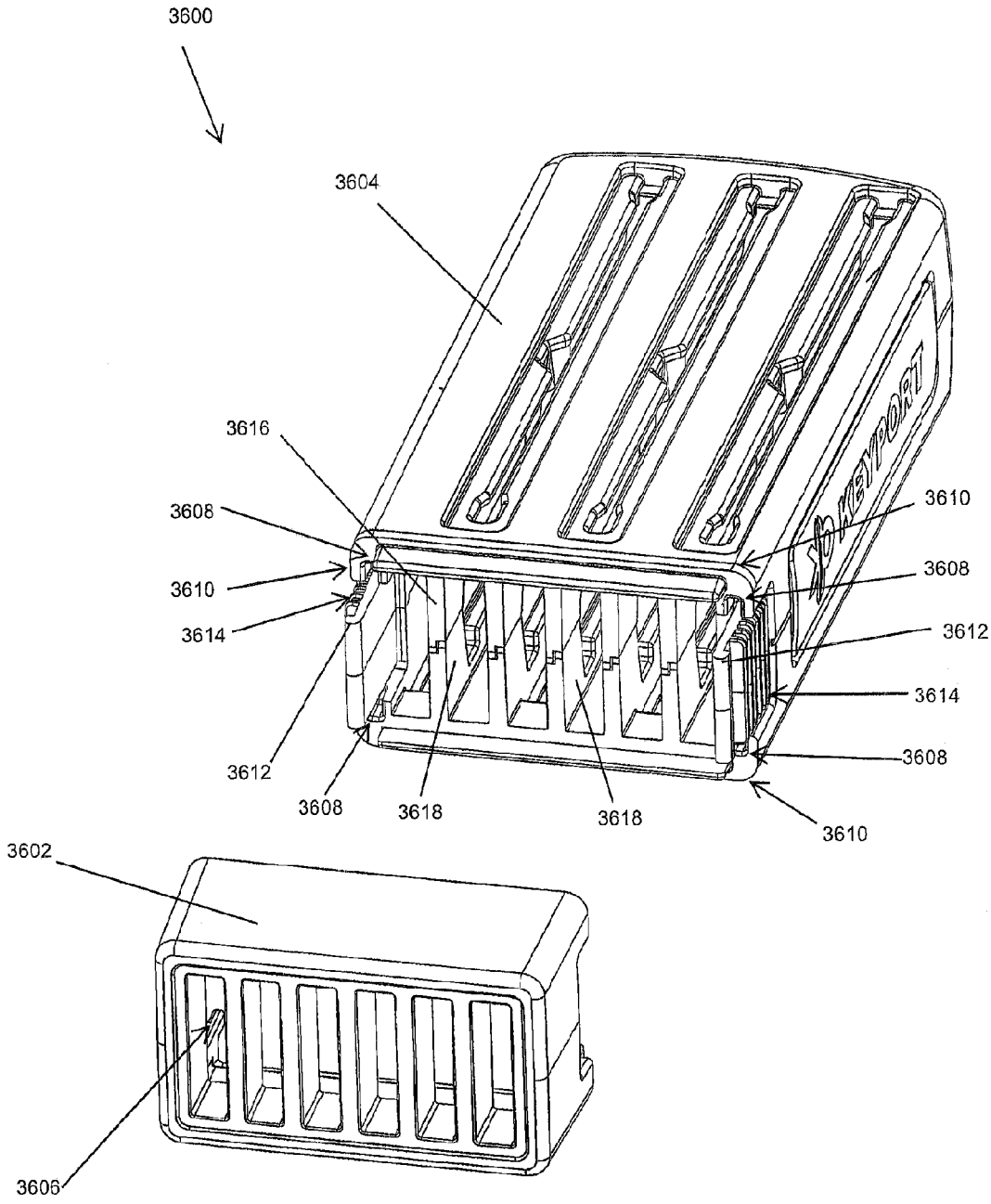
FIG. 36 is a perspective view showing an example of a key organizing device, including a cover and a housing.

FIG. 36 is a perspective view showing an example of a key organizing device 3600. As illustrated, the key organizing device 3600 includes a cover 3602 and a housing 3604, the cover 3602 having been pulled away from the housing 3604.

Figure 37:
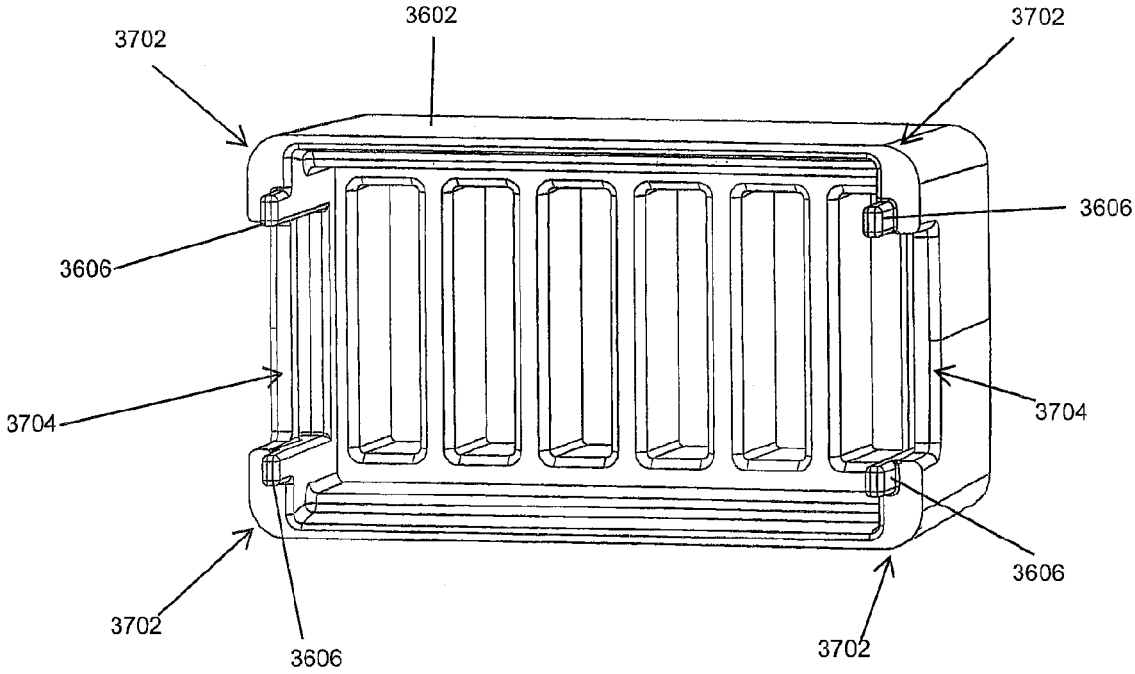
FIG. 37 is a perspective view of the cover shown in FIG. 36.

FIG. 37 is a perspective view of the cover 3602 shown in FIG. 36. The cover 3602 includes a projection 3606 at each of four corners 3702 of the cover 3602, each projection 3606 being configured for insertion into a corresponding slot 3608 set into the housing 3604 near each of four corners 3610 of the housing 3604. The projections 3606 together form a bezel configured for engaging the housing 3604 for removable attachment of the cover 3602. The housing may include hooks 3612 for engaging slots 3704 inside the cover 3602. The housing 3604 may have two friction plates 3614 adjacent to the hooks 3612 for gripping the housing 3604. The hooks 3612 may be disengaged from the slots 3704 by squeezing the two friction plates 3614 together, deflecting the two hooks 3612 toward each other. In an example, the housing may include first and second interior walls having end portions 3616, 3618 together forming an end-stop for sliders (not shown), the interior walls (not shown) otherwise corresponding to the first and second interior walls 2402-2408, 2502-2508 discussed in connection with the key organizing device 2100.

Figure 38:
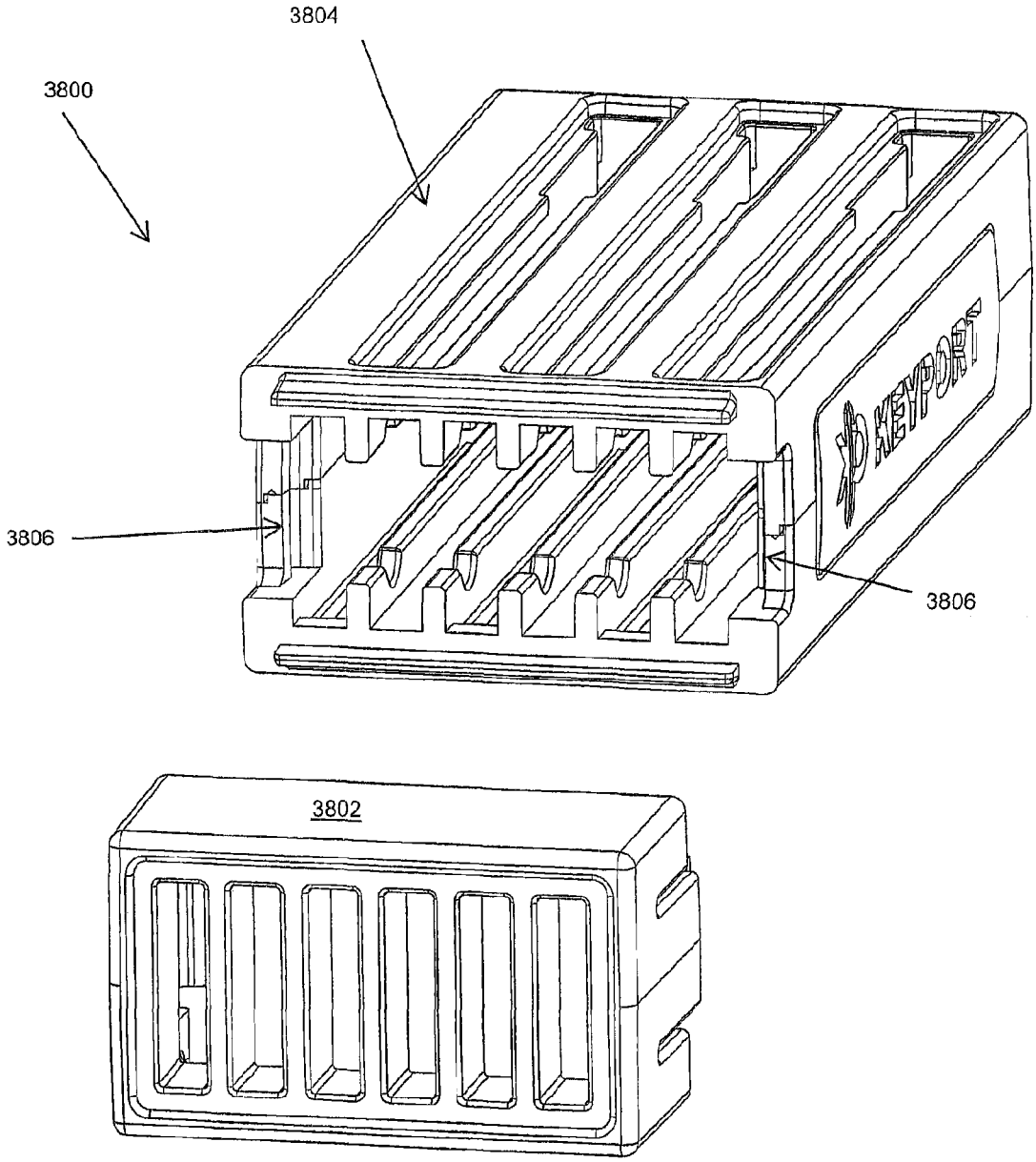
FIG. 38 is a perspective view showing an example of a key organizing device, including a cover and a housing.

FIG. 38 is a perspective view showing an example of a key organizing device 3800. The key organizing device 3800 including a cover 3802 and a housing 3804, the cover 3802 having been pulled away from the housing 3804.

Figure 39:
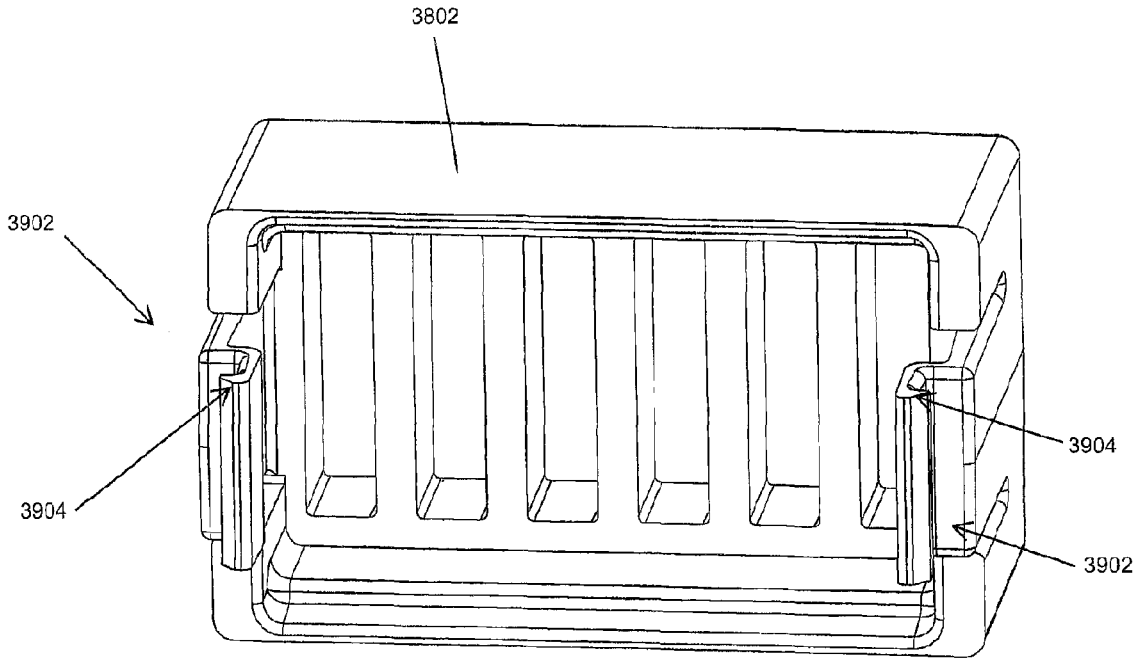
FIG. 39 is a perspective view of the cover shown in FIG. 38.

FIG. 39 is a perspective view of the cover 3802 shown in FIG. 38. The cover 3802 includes two tabs 3902, configured for insertion into two corresponding slots 3806 set into the housing 3804. The tabs 3902 together form a bezel configured for engaging the housing 3804 for removable attachment of the cover 3802. Each of the tabs 3902 may include a hook 3904 for engaging the corresponding slot 3806 inside the cover 3802. The hooks 3904 may be disengaged from the slots 3806 by squeezing the two tabs 3902 together, deflecting the two hooks 3904 toward each other.

Figure 40:
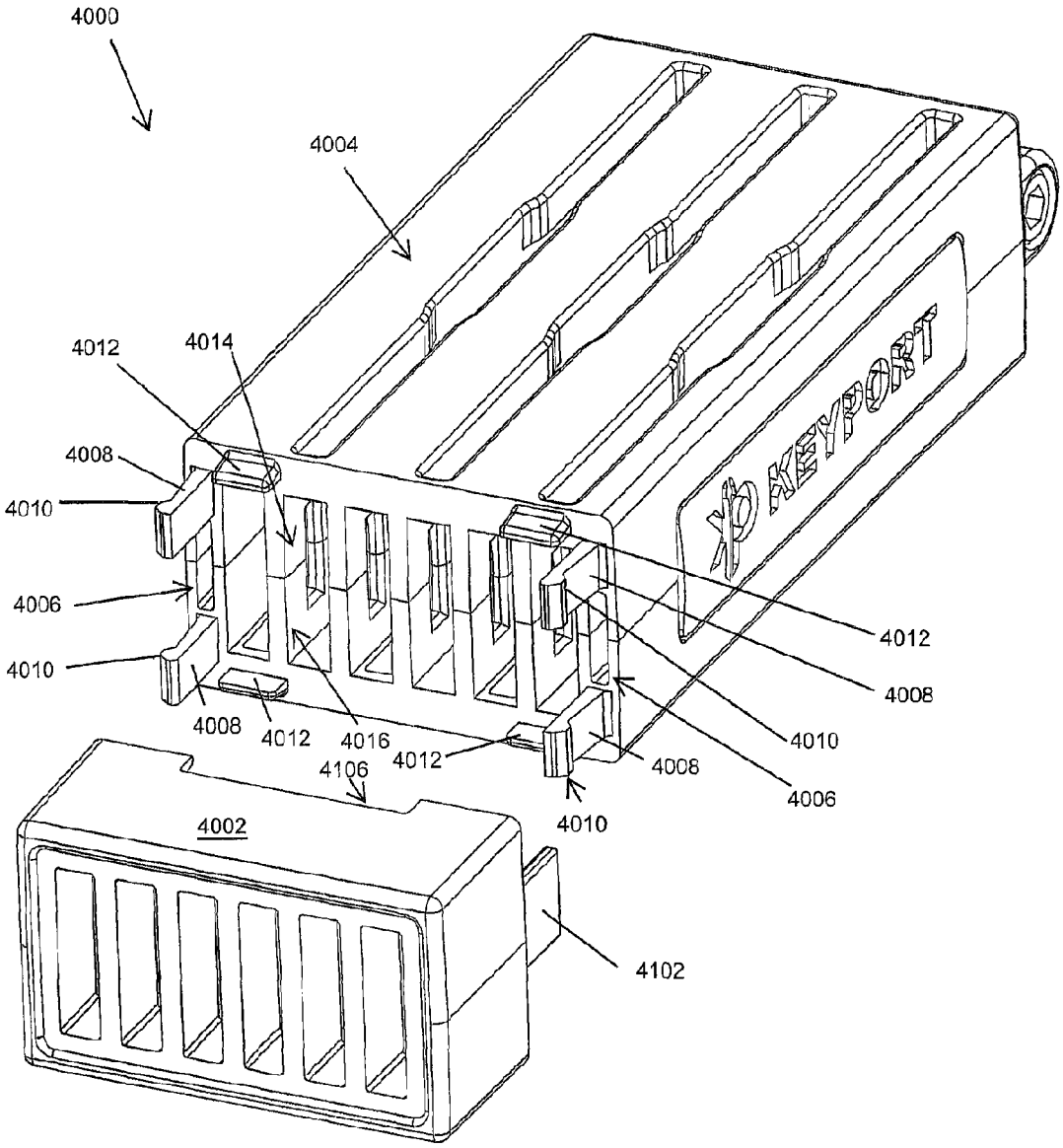
FIG. 40 is a perspective view showing an example of a key organizing device, including a cover and a housing.

FIG. 40 is a perspective view showing an example of a key organizing device 4000. The key organizing device 4000 includes a cover 4002 and a housing 4004, the cover 4002 having been pulled away from the housing 4004.

Figure 41:
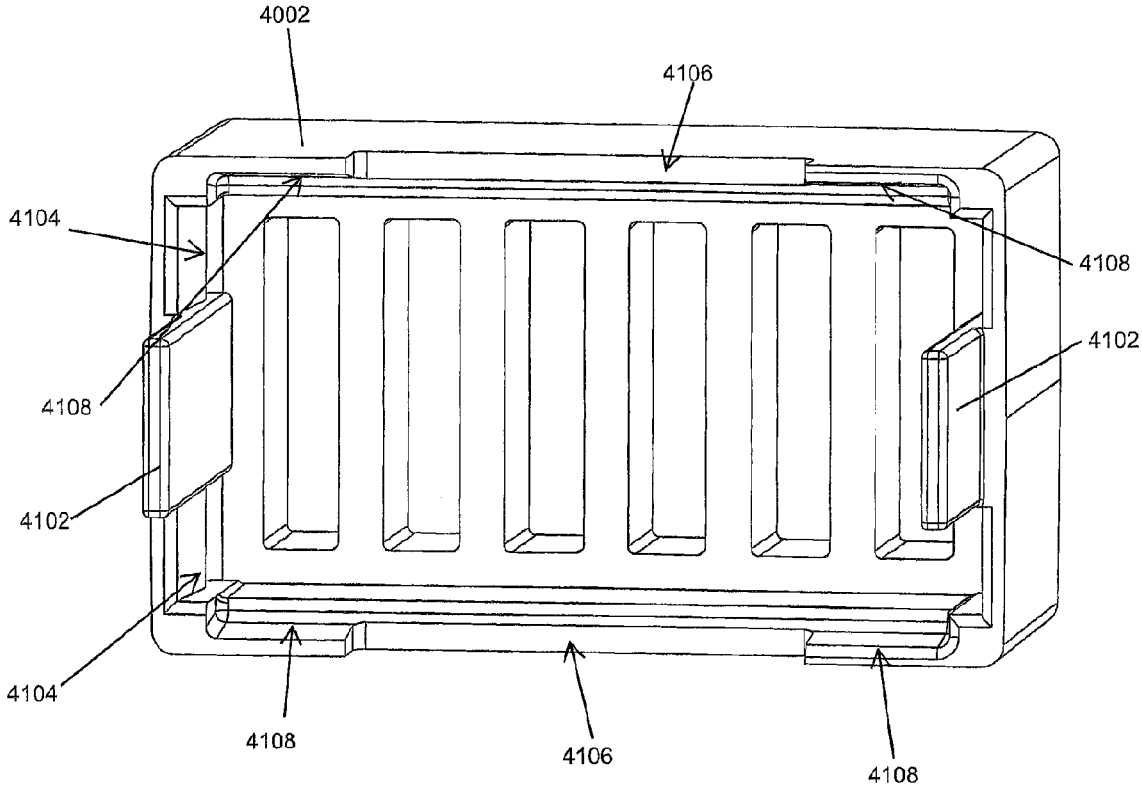
FIG. 41 is a perspective view of the cover shown in FIG. 40.

FIG. 41 is a perspective view of the cover 4002 shown in FIG. 40. The cover 4002 includes two tabs 4102, configured for insertion into two corresponding slots 4006 set into the housing 4004. The housing includes four tabs 4008, configured for insertion into four corresponding slots 4104 in the cover 4002. Each of the tabs 4008 may include a hook 4010 for engaging a corresponding hook (not shown) in the corresponding slot 4104 inside the cover 4002. The tabs 4008 in the housing 4004 together form a bezel configured for engaging the cover 4002 for removable attachment of the cover 4002. The hooks 4010 may be disengaged from the slots 4104 by inserting a flat object such as a coin (not shown) into a slot 4106 between the cover 4002 and the housing 4002 to pry the cover 4002 away from the housing 4004. The housing 4004 may further include four guide tabs 4012 configured for engaging corresponding grooves 4108 in the cover 4002. As an example (not shown), the tabs 4102 and the slots 4006 may include hooks configured for mutual attachment, in addition to or instead of the hooks 4010. In an example, the housing 4004 may include first and second interior walls having end portions 4014, 4016 together forming an end-stop for sliders (not shown), the interior walls (not shown) otherwise corresponding to the first and second interior walls 2402-2408, 2502-2508 discussed in connection with the key organizing device 2100.

Figure 42:
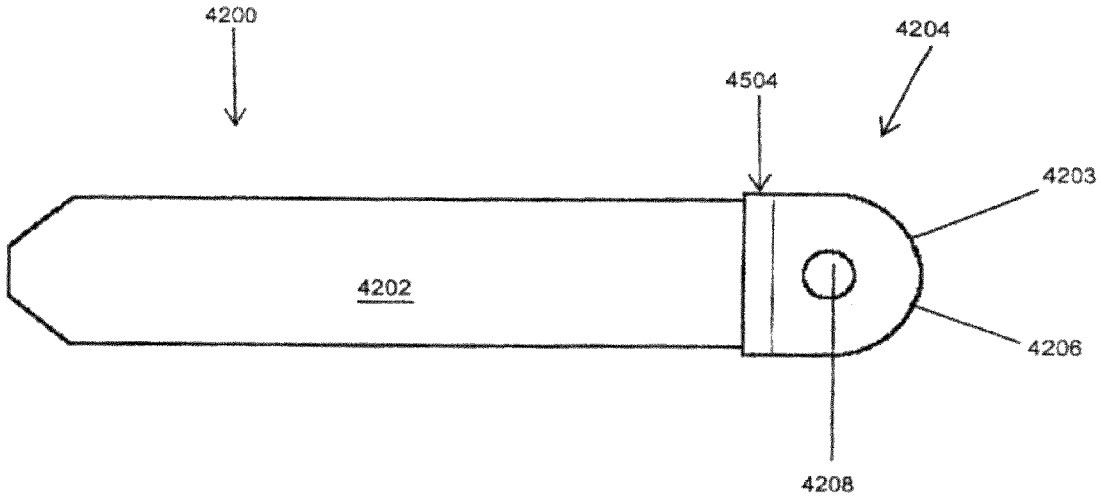
FIG. 42 is a side view showing an example of another implementation of a key.

FIG. 42 is a side view showing another example of an implementation of a key 4200 that may be utilized as the keys 320 shown in FIG. 1 and discussed earlier. The key 4200 may be removeably attached to the key mount 3204 of the example 3200 of a slider as earlier discussed and as shown in FIGS. 32-35.

Figure 43:
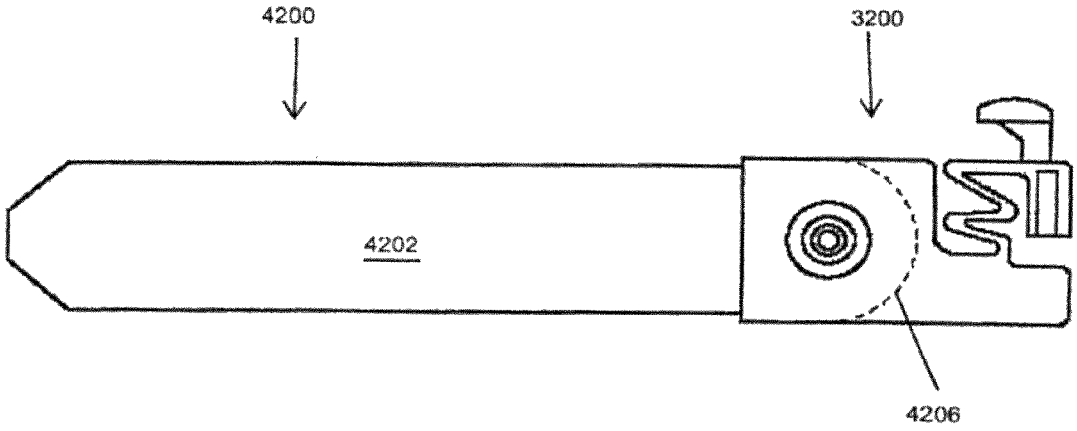
FIG. 43 is another side view of the key shown in FIG. 42, removeably attached to the example of a slider shown in FIG. 32.

FIG. 43 is another side view of the key 4200 shown in FIG. 42. The key 4200, as illustrated, is removeably attached to the example slider 3200 shown in FIG. 32.

Figure 44:
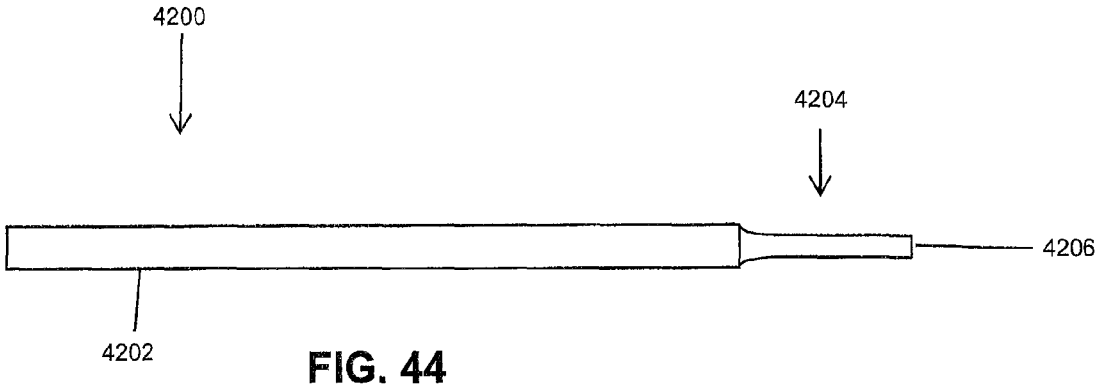
FIG. 44 is a top view of the key shown in FIG. 42.
Figure 45:
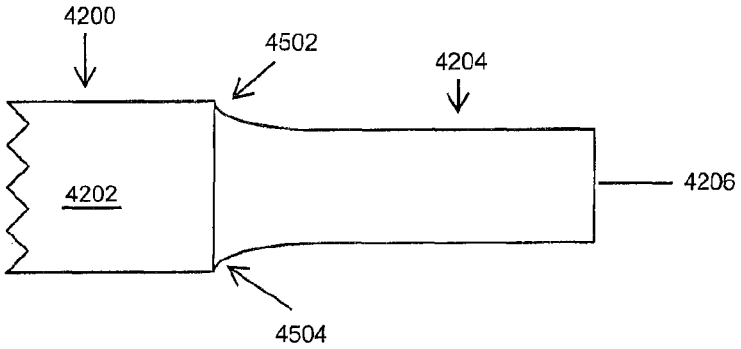
FIG. 45 is another top view of part of the key as shown in FIG. 44.

FIG. 44 is a top view of the key 4200 shown in FIG. 42. FIG. 45 is another top view of part of the key 4200 as shown in FIG. 44. The key 4200 includes a key blade 4202, and a key head 4204 connected to the key blade 4202. The key head 4204 has an edge 4206, and a head aperture 4208 in the key head 4204. FIG. 42 also shows one side 4203 of the key head 4204; another side is opposite the side 4203. The head aperture 4208 is spaced apart from the edge 4206. The key head 4204 includes tapered ramps 4502, 4504 each narrowing toward the edge 4206 in a direction passing through the head aperture 4208. The key mount 3204 may be configured for guiding the mounting post 3210 into and out of the head aperture 4208, and for resting over the tapered ramps 4502, 4504. The key mounting plates 3206, 3208 may be configured for sliding over the tapered ramps 4502, 4504. Inside surfaces 3306, 3308 of the key mounting plates 3206, 3208 may be tapered (not shown) in conformance with the tapered ramps 4502, 4504.

Figure 46:
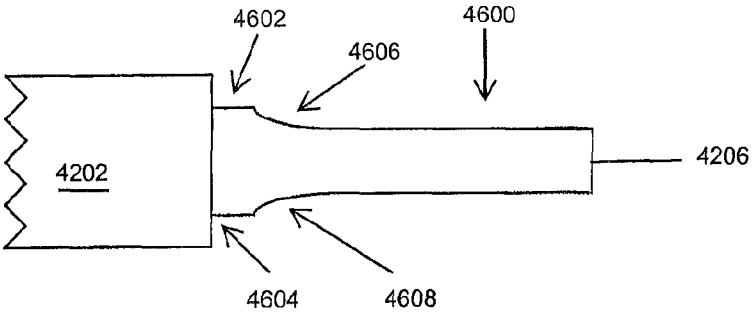
FIG. 46 is a top view showing an example of the key shown in FIGS. 42-45.

FIG. 46 is a top view showing an example 4600 of the key 4200 shown in FIGS. 42-45 and discussed above, and that may be removeably attached to the key mount 3204 of the example 3200 of a slider as earlier discussed and as shown in FIGS. 32-35. The example 4600 of the key 4200 includes stop ridges 4602, 4604. The example 4600 of the key 4200 also includes tapered ramps 4606, 4608 terminating at the stop ridges 4602, 4604. The key mount 3204 may be configured for guiding the mounting post 3210 into and out of the head aperture 4208, and for resting against the stop ridges 4602, 4604 and over the tapered ramps 4606, 4608. The key mounting plates 3206, 3208 may be configured for sliding over the tapered ramps 4606, 4608 and for resting the frontal edges 3214, 3216 of the key mount 3204 in contact with the stop ridges 4602, 4604, respectively.

The key organizing devices 100, 2100, 3600, 3800, 4000 may be fabricated from materials selected for suitable durability, functionality and appearance of the key organizing devices 100, 2100, 3600, 3800, 4000. For example, the housing 204, 2102, 3604, 3804, 4004 may be formed of a plastic, metal, or graphite material. As a plastic material, Lustran® 248 acrylonitrile-butadiene-styrene ("ABS") may for example be utilized in forming the housings 204, 2102, 3604, 3804, 4004. An indicia plate 326 may be formed of the same material selected for the housing 204, 2102, 3604, 3804, 4004. Where the cover 104, 2104, 3606, 3802, 4002 of a key organizing device 100, 2100, 3600, 3800, 4000 includes tabs 2008, 4008, the cover 104, 2104, 3606, 3802, 4002 may be formed of a flexible material such as a plastic composition. Likewise, where the housing 204, 2102, 3604, 3804, 4004 of a key organizing device 100, 2100, 3600, 3800, 4000 includes tabs 2008, 4008, the housing 204, 2102, 3604, 3804, 4004 may be formed of a flexible material such as a plastic composition. Where the cover 104, 2104, 3606, 3802, 4002 or housing 204, 2102, 3604, 3804, 4004 does not include tabs 2008, 4008, then that cover 104, 2104, 3606, 3802, 4002 or housing 204, 2102, 3604, 3804, 4004 may instead be formed of a minimally-flexible material such as a metal composition. As an example of a metal composition, aluminum alloy 380 may be die-cast and utilized. The sliders 106, 2600, 3200 may be formed, for example, from a flexible material such as a plastic composition. As an example, DuPont Delrin 100T® may be utilized. The keys 320, 800, 2800, 4200, 4600 may, for example, be formed of a metal alloy. CDA 353 brass is an example of a suitable metal alloy for forming keys 320, 800, 2800, 4200, 4600. A slider dampener 2216, 2316, in a key organizing device 100, 2100, 3600, 3800, 4000 may be formed from a material having suitable flexibility and durability for frequent deformation as sliders 106, 2600, 3200 are deployed. For example, a polyurethane foam having Shore Durometer 50A+/−5 hardness may be utilized in forming a slider dampener 2216, 2316. A key dampener 1706 in a key organizing device 100, 2100, 3600, 3800, 4000 may be formed from a material having suitable flexibility and durability for frequent sliding engagement with keys 320, 800, 2800, 4200, 4600 as sliders 106, 2600, 3200 are deployed. As an example, Poron Quick-Recovery super-resilient open cell polyurethane foam, having a firmness of 8-14 pounds per square inch, a density of 15 pounds per cubic foot, a 100% stretch limit, and a tensile strength of 80 pounds per square inch may be utilized. Pins 3508 in sliders may be formed, for example, of a metal alloy such as 303 stainless steel. Exterior surfaces of key organizing devices 100, 2100, 3600, 3800, 4000 may have decorative surfaces, such as multiple-colored first and second housing elements 308, 310 for example.

Dimensions for the key organizing devices 100, 2100, 3600, 3800, 4000 and keys 320, 800, 2800, 4200, 4600 may be selected consistent with factors including utility and portability, as well as standardization. For example, key organizing devices 100, 2100, 3600, 3800, 4000 may be selected to hold six (6) keys 320, 800, 28004200, 4600, including three (3) keys 320, 800, 2800, 4200, 4600 having finger pads 402, 2602, 3202 exposed outside each of first and second housing elements 308, 310, 2108, 2110. Key organizing devices 100, 2100, 3600, 3800, 4000 configured with other arrangements of finger pads 402, 2602, 3202 and configured for holding different quantities of keys 320, 800, 2800, 4200, 4600 may also be fabricated. For example, a key organizing device 100, 2100, 3600, 3800, 4000 configured for holding six (6) keys 320, 800, 2800, 4200, 4600 may have overall dimensions including a width of about 1.17 inches, a height of about 0.67 inches, and a length of about 2.75 inches. Key slots 2002 may be, for example, about 1.0 inch tall and about 0.45 inch wide. Keys 320, 800, 2800, 4200, 4600 may, for example, be standardized with blades 902 having a thickness yyy within a range of between about 0.07 inch and about 0.10 inch, key heads 1002 having a width zzz of about 0.44 inch, and key head edges 906 having a thickness of about 0.1 inch. Keys 320, 800, 2800, 4200, 4600 and key organizing devices 100, 2100, 3600, 3800, 4000 may be mutually configured, for example, to provide a standardized deployment length for a key blade 902 in an extended position, such as about 1.9 inches. A key blade deployment length of 1.9 inches may provide at least about one-eighth of an inch of clearance between the key organizing device 100, 2100, 3600, 3800, 4000 and a lock (not shown) when a key 320, 800, 2800, 4200, 4600 is in use, to prevent scratching of the lock.

Keys 320, 800, 2800, 4200, 4600 may be configured for a wide variety of types of end-utilization, for example as keys 320, 800, 2800, 4200, 4600 for a vehicle, mailbox, deadbolt, house, office, or security lock. The key organizing device 100, 2100, 3600, 3800, 4000 may, for example, be utilized for holding a plurality of end-user selected keys 320, 800, 2800, 4200, 4600 or other implements configured for attachment into the key organizing device 100, 2100, 3600, 3800, 4000, such as a bottle opener, pen, knife, file, radio frequency identification fob, or bar code fob. Likewise, the keys 320, 800, 2800, 4200, 4600 may be configured for end-utilization in a wide variety of types of locks, or for holding non-key implements. While the foregoing description refers in some instances to the key organizing devices 100, 2100, 3600, 3800, 4000, and the keys 320, 800, 2800, 4200, 4600 as shown in the figures, it is appreciated that the subject matter is not limited to these structures, nor to the structures discussed in the specification. Other shapes and configurations of key organizing devices and keys may be fabricated.

Moreover, it will be understood that the foregoing description of numerous examples has been presented for purposes of illustration and description. This description is not exhaustive and does not limit the claimed invention to the precise forms disclosed. Modifications and variations are possible in light of the above description or may be acquired from practicing the invention. The claims and their equivalents define the scope of the invention.

What is claimed is:

1. A key organizing device, comprising:

a housing comprising a cavity, two housing ends spaced apart in a longitudinal direction, an end opening at one of the housing ends, a back wall at the other housing end, and a slider opening extending in the longitudinal direction;

a slider comprising a finger pad, a key mount, a tensioning member interposed therebetween, and a guide projection;

and a key comprising a key blade and a key head, wherein:

the key mount comprises spaced-apart first and second key mounting plates, the first key mounting plate comprising a mounting post projecting toward the second key mounting plate; and the key head comprises a key-head edge, a key-head ramp positioned between the key-head edge and the key blade, and a key-head aperture spaced apart from the key-head edge; and further wherein:

the key is attached to the slider by positioning the mounting post through the key-head aperture;

the key mount is positioned inside the cavity and connected to the finger pad through the slider opening;

the slider opening defines a path for the slider and is configured to allow the guide projection to enter a notch at a key-retracted end position and to enter another notch at a key-extended end position, each notch being configured for reversibly locking the slider in the end position thereof;

the finger pad is configured for pushing the guide projection out of the notches upon depression of the finger pad toward the housing to release the slider from the end positions;

the slider is configured for attachment and detachment of the key from the device through one of the housing ends; and the key and the key mount are mutually configured based on standardization of the key head to a specified width and the key-head edge to a specified thickness, independent of the thickness of the key blade.

2. The device of claim 1, wherein:

the housing comprises spaced-apart first and second housing base walls respectively having first and second interior surfaces facing each other in the cavity; and the interior surface of one of the first and second housing base walls has two interior walls spaced apart on the interior surface and projecting toward the interior surface of the other of the first and second housing base walls, the two interior walls guiding the slider along a path in the longitudinal direction in alignment with the slider opening.

3. The device of claim 2, wherein the device comprises a plurality of slider openings alternately extending through the first housing base wall and the second housing base wall.

4. The device of claim 1, wherein:

the housing comprises spaced-apart first and second housing base walls respectively having first and second interior surfaces facing each other in the cavity; and the slider comprises first and second glide plates respectively contacting the first and second interior surfaces, where the slider is configured for gliding on the first and second glide plates over the first and second interior surfaces.

5. The device of the claim 4, wherein the interior surface of one of the first and second housing base walls has two interior walls spaced apart on the interior surface and projecting toward the interior surface of the other of the first and second housing base walls, the two interior walls guiding the slider along a path in the longitudinal direction in alignment with the slider opening.

6. The device of claim 5, wherein:

the guide projection is configured to glide along a surface of at least one of the interior walls; and the interior walls are spaced apart at a distance configured to press the guide projection between the interior walls.

7. The device of claim 6, wherein the device comprises a plurality of slider openings alternately extending through the first housing base wall and the second housing base wall.

8. The device of claim 1, wherein the slider is configured for attachment and detachment of the key from the device through the end opening.

9. The device of claim 1, further comprising another end opening at the other housing end, and wherein:

the back wall is removable; and the slider is configured for attachment and detachment of the key from the device through the another end opening.

10. The device of claim 1, wherein the key head further comprises two guide ridges, the key-head ramp being between the two guide ridges.

11. The device of claim 1, wherein the key head further comprises a notch extending from the key-head aperture to the key-head edge.

12. The device of claim 11, wherein the key-head aperture is configured for receiving the mounting post, and the key head is configured for guiding the mounting post into and out of the key-head aperture.

13. The device of claim 11, wherein:

the key head further comprises a ridge over at least a part of the key-head edge;

and the ridge is configured for receiving the first or second key mounting plate.

14. The device of claim 1 wherein the attachment of the key to the slider is reversible.

15. The device of claim 1, wherein the slider opening comprises a slot edge and a slider dampener on the slot edge.

16. The device of claim 1, further comprising a key dampener at the end opening, the key dampener comprising a key slot configured for sliding engagement of a key blade.

17. The device of claim 1, further comprising a key dampener at the end opening, the key dampener comprising a key slot having two spaced apart slot surfaces configured for sliding engagement of a key blade, the key slot comprising two flexible slot ends.

18. The device of claim 1, further comprising a cover removably attached over the end opening.

19. The device of claim 18, wherein the cover comprises a bezel having two spaced-apart tabs engaging the housing for removable attachment of the cover over the end opening.

20. The device of claim 1, the housing further comprising first and second housing elements configured for together forming the housing, each of the housing elements having a housing base wall, the slider opening being located in a housing base wall.

21. The device of claim 1, wherein the tensioning member comprises a spring element.

22. A method of use of the device of claim 1, comprising:

depressing the finger pad toward the housing to release the slider from the key-retracted end position; and moving the finger pad along the slider opening to extend the key from the housing.

23. A method of use of the device of claim 1, comprising:

depressing the finger pad toward the housing to release the slider from the key-extended end position; and moving the finger pad along the slider opening to retract the key into the housing.

* * * * *